United States Patent [19]

Blitchington

[11] 4,205,769

[45] Jun. 3, 1980

[54] METHODS OF AND SYSTEM FOR COUNTING HOLES AND FOR DETECTING MISSING HOLES IN A WEB

[75] Inventor: Frank H. Blitchington, Richmond, Va.

[73] Assignee: Western Electric Company, Inc., New York, N.Y.

[21] Appl. No.: 903,338

[22] Filed: May 5, 1978

[51] Int. Cl.[2] ..... B65H 25/10; B65H 25/16

[52] U.S. Cl. ..... 226/24; 83/61; 83/365; 226/45; 234/34; 250/563

[58] Field of Search ..... 226/24, 10, 34, 35, 226/37, 42, 43, 45; 83/61, 360, 364, 365, 367; 234/30, 33, 34; 250/571, 572, 563, 223 R; 235/92 PC, 92 PK; 340/674

[56] References Cited

U.S. PATENT DOCUMENTS

| | | | |
|---|---|---|---|
| 2,994,783 | 8/1961 | Looschen | 83/365 X |
| 3,019,347 | 1/1962 | Laycak | 250/223 R |
| 3,188,478 | 6/1965 | Binks . | |
| 3,244,810 | 4/1966 | Williams . | |
| 3,280,692 | 10/1966 | Milnes et al. | |
| 3,389,789 | 6/1968 | Watson et al. | |
| 3,665,444 | 5/1972 | Scott | 250/223 B X |
| 3,717,751 | 2/1973 | Fluck | 235/92 PK |
| 3,783,293 | 1/1974 | Gold et al. | 226/45 X |
| 3,835,332 | 9/1974 | Bridges | 250/563 |
| 3,933,069 | 1/1976 | Tall et al. | 83/365 X |
| 4,024,381 | 5/1977 | Fluck | 235/92 PK |
| 4,140,390 | 2/1979 | Schultheis et al. | 83/61 X |

*Primary Examiner*—Stanley N. Gilreath
*Attorney, Agent, or Firm*—J. B. Hoofnagle

[57] ABSTRACT

A continuous web or laminate (32) of flexible material is indexed through a punch press (44) whereat holes of different shapes and sizes are punched in repetitive patterns through successive sections of the laminate. The laminate (32) is then moved beneath a light source (48) so that light passes through the holes and is sensed by a light-sensing camera (52) which laterally and cyclically scans at a rapid rate the underside of the moving laminate.

During the rapid scanning by the camera (52), each hole may be scanned many times due to the size and shape of the hole. Consequently, light is sensed many times for the same hole and a corresponding number of signals are developed by the camera. A hole counting system (46), which receives the developed signals from the camera (52), includes a delay-and-compare circuit (66) wherein each signal related to a given hole is delayed by one scan cycle and compared with the next signal related to the same hole. When the given hole has passed, the camera (52) does not sense light on the next scanning cycle. This condition, when compared with the immediately previous light-sensed condition, results in the development of an output hole-count pulse from the delay-and-compare circuit (66).

The count pulses of each section of the laminate (32) are fed to a counter-comparator circuit (70), and are counted and compared with a desired preset count for each section. If the actual and preset counts of a selected number of successive sections do not compare, an alarm is sounded and a signal is fed to the punch press (44) to stop the punching operation.

19 Claims, 17 Drawing Figures

218
218a
218b
218c
218d
+V
226
230
240
244
238
219
219a
219b
219c
219d
FAULT SIGNAL
TO FIG. 10B
234
236
S
R
Q̄
Q
220
220a
220b
220c
220d
242
FAULT-DETECT RESET
FROM FIG. 10B
221
221a
221b
221c
221d
228
232

METHODS OF AND SYSTEM FOR COUNTING HOLES AND FOR DETECTING MISSING HOLES IN A WEB

BACKGROUND OF THE INVENTION

1. Field of the Invention

This invention relates to methods of and a system for counting holes in a web and for detecting missing holes and, particularly, to methods of and a system for counting holes in successive sections of a moving flexible web and for determining whether each section contains the exact number of holes required.

2. Discussion of the Prior Art

In the manufacture of flexible printed circuits, a laminate is processed through many stations in forming the circuits. The laminate initially includes a plastic substrate having copper clad to one, or both, major surfaces thereof. The laminate is available in rolls of substantial lengths, such as 550 feet, and provides a base for the manufacture of many printed circuits of the same pattern formed in successive circuit sections of the laminate. Also, the laminates are available in different widths.

Each section of the laminate is indexed through a punch press to form a plurality of holes and slots therethrough of different sizes and shapes. For example, depending on the code of the circuit to be made, each circuit section could have as few as seventeen holes or as many as 2700 holes. Many of the holes are extremely small and are usually round while other larger holes may be round, square or oblong. Each hole is required in the ultimate formation of the printed circuit in order for the circuit to perform as designed. Thus, it is critically important that the required holes and slots be formed in each circuit section of the copper-clad laminate when the successive sections are indexed through the punch press.

On occasion, the punches of the punch press become worn or damaged, or the punches may be missing. In any case, such defective or missing punches result in a missing hole, or holes, in each of the successive circuit sections. If the missing holes are not detected, a complete length, or many lengths, of the laminate could be processed through the punch press and through the printed circuit forming facilities. The occurrence of the missing holes would not become apparent until after the actual circuits have been formed and are processed through final testing. Since the holes are through-plated during the manufacturing process, it would be a practical impossibility to drill holes in the completed circuit where missing holes are detected during final testing. Consequently, not only would there be a loss of many rolls of the laminate, there would also be a costly loss in processing time, use of equipment and personnel time.

It is possible that more than the required number of punches could be included accidently in the punch press which would result in too many holes in each section of the laminate. This will also result in the loss of rolls of laminate.

Thus, it becomes apparent that some form of inspection of the laminate is required as the successive sections exit from the punch press.

Due to (1) the rapid rate at which the laminate moves through the punch press, (2) the minuteness of many of the holes, (3) the number of holes, (4) the different sizes and shapes of the holes and (5) the length of laminate to be examined, it is a practical impossibility to perform a visual inspection. Thus, it becomes obvious quickly that an automatic hole-detecting system must be used.

Since light can be passed through the holes and slots, it would appear that a light-sensing system operating at a rate compatible with the speed of the moving laminate would be able to count the holes. Further comparison techniques could be employed to determine whether any of the successive sections contain less than the desired number of holes.

In consideration of a light-sensing system, many side-to-side scans of the moving laminate must be employed to insure that the smallest hole is detected and counted. Due to the minuteness of the small holes, the scan frequency of any light-sensing system used must be sufficient to provide at least one scan line to sense the light passing therethrough. Consequently, the larger holes will be scanned several times. Since the light-sensing system would typically respond and count each time light is sensed, each of the larger holes would provide a light-sensed condition each time it is scanned and thereby provide multiple counts for a single hole. Obviously, a system of this type would not satisfy the requirements of examining a laminate having holes of different sizes and shapes.

The pattern of holes and slots is repeated many times along a roll or length of the laminate. If a light-sensing system is used, it must be reset at extremely short intervals to insure that it examines each circuit section with no carryover of hole count from preceding sections.

An examination of commercially available equipment quickly revealed that the available light-sensing systems were not capable of solving the problems outlined above.

Several prior art systems, as outlined below, use a photosensitive device, such as a vidicon or television camera, to scan an image in search of various information such as defects.

U.S. Pat. No. 3,019,347, to J. F. Laycak, teaches the use of a vidicon tube to scan a moving steel slab in search for defects of a light-reflective property differing from the normal light-reflective property of the slab. The total area of all defects in the slab is computable. The sensing of opposite edges of the slab generates pulses which would normally denote defects in the slab. A pulse-delay technique permits the complete cancellation of the edge-generated pulses. Also, pulses generated upon the scanning of very narrow defects are cancelled to minimize error in the final area computation.

U.S. Pat. No. 3,244,810, to D. A. Williams, teaches a system using a conventional television camera to scan a stationary object to obtain a variety of data regarding the object. An intercept scanning technique is employed wherein an imaginary line is formed through the object by using delays based on the first intercept of the object and provides a count pulse each time the line is scanned to indicate the continued presence of the object.

U.S. Pat. No. 3,280,692, to J. A. Milnes et al., teaches the use of a conventional television camera to scan a light-reflecting tin strip in search of flaw-like defects on each of left-hand and right-hand sides of the strip. For example, as each defect is scanned on the left-hand side, a pulse is developed. Where pulses occur on successive scans, it is indicative of a single recurring defect. The first absence of such a pulse denotes the end of the defect. The pulses of each scan are then integrated and converted into a square wave which is differentiated to provide a single pulse to represent the defect. If other defects are detected on the same scans, the pulses developed in response thereto are absorbed in the integration of the pulse of the prior detected defect and ultimately are absorbed in the count of the prior defect. Consequently, this system can count only one defect for each of the left-hand and right-hand sides on each scan. These pulses provide a defect count and are used to compute total area of defect in the strip.

U.S. Pat. No. 3,389,789, to G. L. Watson et al., teaches the use of a television camera to scan a moving discrete object in search of flaws. In a first embodiment, an actuator or indicator is set when the first flaw in the object is detected and remains set until the trailing edge of the moving object trips a switch to reset the system. In a second embodiment, each flaw on selected scan lines are counted as a measure of acceptability of the object. Also, facilities are provided for detecting flaw indications on spaced scan lines and utilizing such data as an indication of a single flaw spanning the spaced scan lines.

U.S. Pat. No. 3,835,332, to R. E. Bridges, teaches the use of a light-sensing scanning system to sense defects in a moving web. Signals are generated when defects are sensed and compared with the amplitude of standard signals. The results of the comparison are displayed and sound an alarm.

U.S. Pat. Nos. 3,188,478; 3,665,444; 3,717,751 and 4,024,381 all teach the use of detection systems to sense holes, objects or defects.

Thus, even though the foregoing patents teach light-sensing systems, none of these patents teach a system for providing a "one" count for each of a plurality of multiple-scanned, light-sensed holes detected on each scan. Nor do they teach a system for providing a "one" count for each of a plurality of multiple-scanned, light-sensed holes of successive sections of a web, comparing a totalization of such "one" counts for each of the successive sections with a preset total and resetting the system after each section is counted in preparation for the counting of the next section of the web.

SUMMARY OF THE INVENTION

This invention contemplates a method and a system for counting holes in a web wherein light is passed through a plurality of holes in the web and scanned along successive scan lines by a light-sensitive sensor. As each hole is scanned, a pulse is developed and delayed. The delayed pulse is then compared with the next pulse developed by light passing through the same hole during a subsequent scan. This pattern is repeated through subsequent scans until the first scan beyond the hole does not sense light whereby no pulse is developed to compare with the immediately preceding delayed pulse. In response to this condition, a count pulse is developed to represent a "one" count for each hole of a plurality of holes in each scan line.

This invention further contemplates a method and system for counting holes, as set forth above, in each of a plurality of successive sections of the web. The hole count for each section is compared with a preset count and the system is reset in preparation for counting the holes in the next successive section.

If a preset number of successive sections have one or more holes missing, an alarm is sounded and the web movement is stopped.

DETAILED DESCRIPTION

Figure 1:
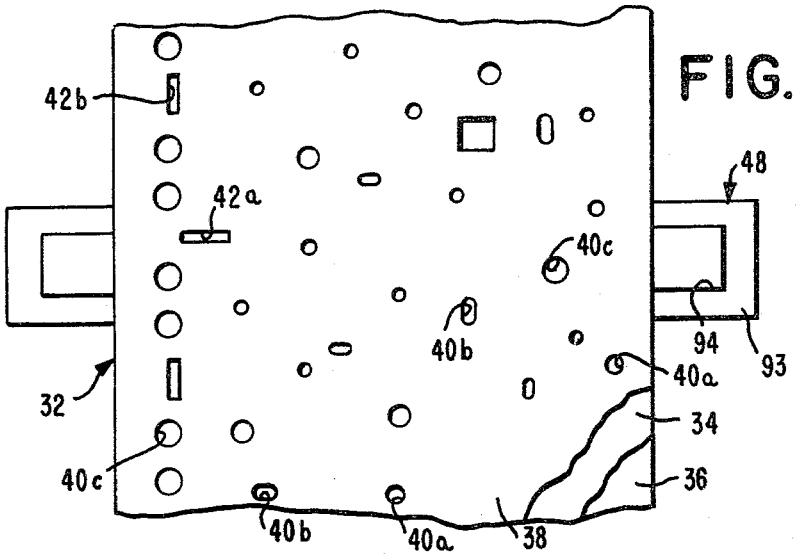
FIG. 1 is a plan view of a section of the underside of a flexible laminate having holes of different shapes and sizes formed therethrough.

Referring to FIG. 1, there is illustrated a section of a web such as a flexible laminate, designated generally by the numeral 32. The laminate 32 could include an inner plastic substrate 34 between thin layers 36 and 38 of copper bonded to opposite sides thereof. The flexible laminate 32 can be used in the manufacture of flexible printed circuits (not shown). In order to prepare the laminate 32 for the manufacture of flexible printed circuits, a plurality of holes 40*a*, 40*b* and 40*c* and slots 42*a* and 42*b* are punched or formed through the laminate. The holes 40*a* and 40*b* ultimately become copper-plated through-holes to electrically link the layer 36 of copper on one side of the inner plastic substrate 34 to the layer 38 of copper on the opposite side thereof. Conventional masking, etching and plating techniques can be employed in the manufacture of printed circuit paths.

The holes 40*a* and 40*b* are formed in the laminate 32 and are illustrated as just a few of the many different sizes and shapes of such holes that could appear in a flexible printed circuit. The holes 40*c* are referred to as tool holes and are used to assist in aligning the laminate 32 as it is located within some of the processing equipment (not shown) used in making the flexible printed circuits. Slots 42*a* (one shown) are referred to as "X" slots while slots 42*b* are referred to as "Y" slots. The "X" and "Y" slots 42*a* and 42*b*, respectively, are used to precisely align the laminate 32 with masking and printing equipment (not shown).

In the manufacture of the flexible printed circuits, a roll or length of about 550 feet of the laminate 32 is processed through successive stations (not shown) where many printed circuits of a repetitive pattern are formed. The roll of laminate 32 is divided lengthwise into many successive sections with each section ultimately forming a printed circuit. For example, each successive section could be twelve inches lengthwise of the laminate 32 or any other dimension depending on the requirements of the printed circuits being manufactured. Each twelve-inch printed-circuit section is centered about an associated one of the "X" slots 36*a* and, depending on the width of the laminate 32, could have as few as seventeen holes or as many as 2700 holes. Code requirements control the number and size of holes 40*a*, 40*b* and 40*c* to be formed in any given circuit section of the laminate 32.

Figure 2:
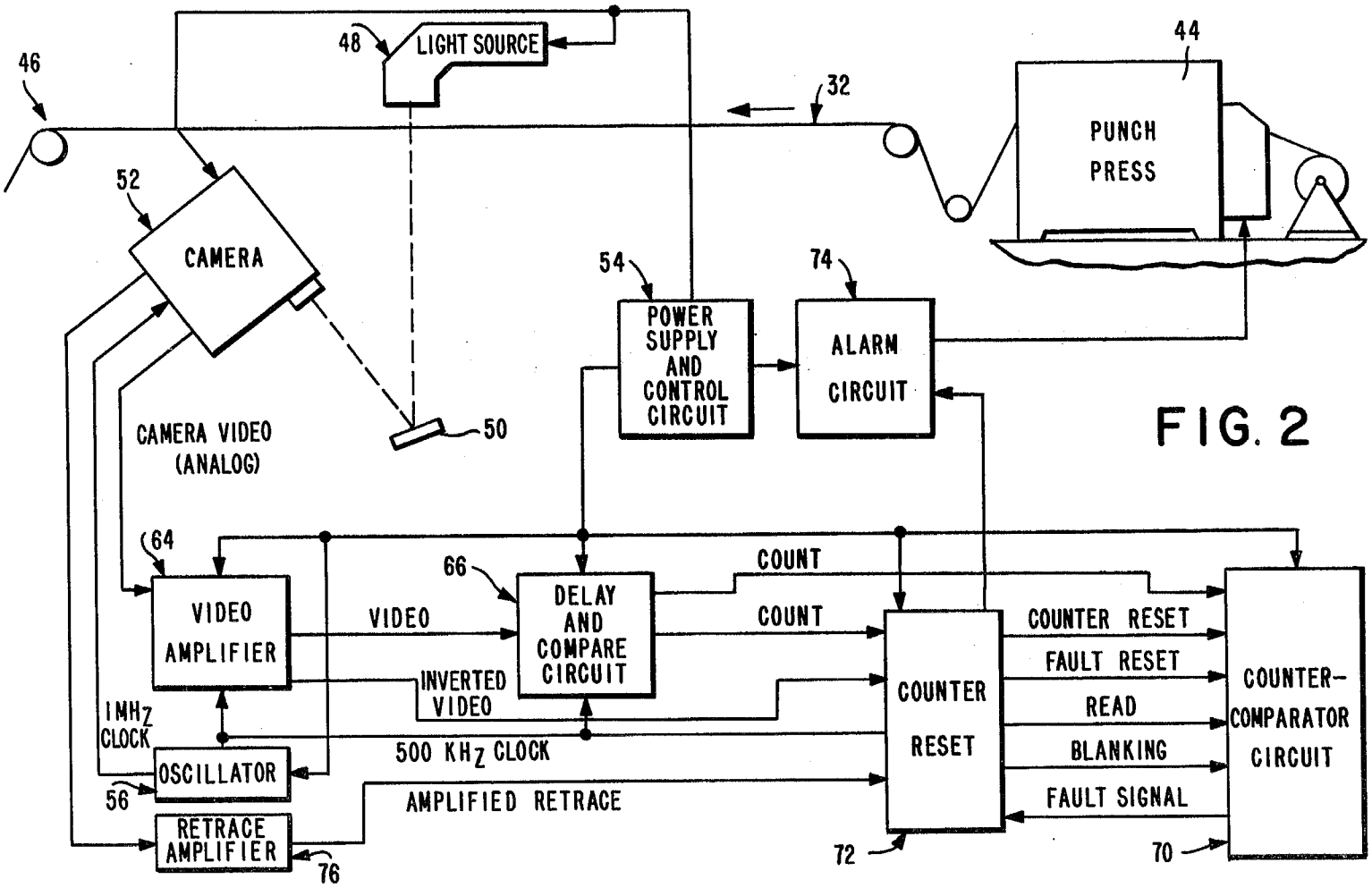
FIG. 2 is a block diagram of a system, which includes a camera containing light-sensing image sensor, for examining a moving laminate of the type illustrated in FIG. 1 to count the holes in the laminate and to detect missing holes in accordance with certain principles of the invention.

Conventionally, the holes 40*a*, 40*b* and 40*c*, and the slots 42*a* and 42*b*, are punched through the laminate 32 within a punch press 44 (FIG. 2). The punch press 44 contains a plurality of punches (not shown) of different sizes and shapes corresponding in number to the holes and slots required for the repetitive-patterned circuits being manufactured. Successive circuit sections of the laminate 32 are indexed through the punch press 44 for the forming of the holes 40*a*, 40*b* and 40*c* and the slots 42*a* and 42*b*. Therefore, it is readily apparent that many circuit sections, with each section containing many holes, are included in a single roll of 550 feet of the laminate 32.

Since the hole-punched rolls of the laminate 32 are further processed through costly operations in the manufacture of flexible printed circuits, it is important that the punching operation be stopped as soon as it is determined that the proper number of holes are not being punched in each circuit section of the laminate. The punching of less than the required number of holes could be caused, for example, by broken, missing or worn punches.

Due to (1) the required speed of the punching operation, (2) the large number of holes, (3) the different shapes of holes, (4) the minuteness of many of the holes and (5) the length of the laminate to be examined, it is a practical impossibility for a successful visual inspection to determine whether any holes are missing.

General System Description

Referring to FIG. 2, there is illustrated a system, designated generally by the numeral 46, for counting the holes 40*a*, 40*b*, 40*c* and the slots 42*a* and 42*b*. The system 46 also detects whether there are any holes or slots missing and provides indication of circuit sections having one or more holes missing.

The system 46 includes a light source, designated generally by the numeral 48, which directs a strip of diffused light onto the upper surface of the moving laminate 32. The light is directed toward a reflecting mirror 50 beneath the moving laminate 32 and is reflected onto a light-sensing, scanning camera designated generally by the numeral 52. The camera 52, which is fixedly mounted, includes a linear image sensor (not shown) which is available from Fairchild Semiconductor of Mountain View, Calif. and is identified as their model number CCD131. The camera 52 also includes a Componon 28 mm, F-4 lens (not shown) for focusing purposes. The lens is manufactured by Schneider Corporation of America, Mineola, New York, and identified as Model No. 11-10334.

The image sensor includes a row of 1,024 sensing elements (not shown) arranged for scanning an image-producing target. The camera 52 further includes a scanning control circuit (not shown) which is also available from Fairchild Semiconductor as their part number SL61267. The control circuit provides all of the bias voltages and clock signal waveforms required for operation of the 1024-element linear image sensor. Also, the control circuit includes an elementary processor circuit which provides low impedance video output signals representative of the conditions sensed by the image sensor elements. Functional timing of the camera 52 is controlled by a video clock signal which can be either internally generated or provided by an external TTL-compatible signal source.

The output video data rate of the camera 52 is one-half the frequency of the video clock signal. For example, a 1 MHz clock signal will result in a video data rate of 500 KHz. Complete circuit diagrams, interconnections and other data are disclosed in a brochure available from Fairchild Semiconductor, entitled "CCD131 Design Development Board Brochure" and dated May, 1976.

The system 46 further includes a power supply and control circuit, designated generally by the numeral 54, which provides operating power to the various components of the system. An oscillator, designated generally by the numeral 56, provides a 1 MHz clock signal which is coupled to the camera 52 to synchronize the camera operation with the remaining synchronized components of the system 46. The oscillator 56 also provides a 500 KHz clock signal to other components of the system 46.

As the laminate 32 moves past the light source 48, the camera 52 rapidly and cyclically scans the width of the moving laminate at a frequency controlled by the frequency of the clock signal coupled to the camera from the oscillator 56.

Since many of the holes 40*a* are minute, the scan frequency must be rapid to insure that such minute holes are scanned at least once. This means that the larger holes 40*a*, 40*b* and 40*c*, and the slots 42*a* and 42*b*, will be scanned more than once. Thus, the counting of each hole and slot in the laminate 32 can not be accomplished by the mere sensing of light.

Figure 3:
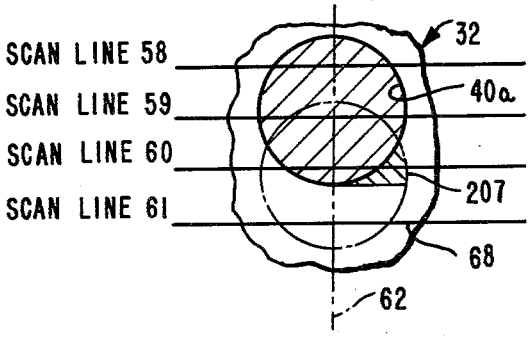
FIG. 3 is a diagram showing the scanning technique utilized by the system of FIG. 2 for counting the holes in accordance with certain principles of the invention.

Referring to FIG. 3, there is illustrated a cross-hatched representation of one of the holes 40*a* in the laminate 32 which is moving upwardly as shown. Four successive scan lines 58, 59, 60 and 61 represent four successive cycles of scanning by the camera 52. Scan lines 58, 59 and 60 clearly pass over the hole 40a whereby the camera 52 senses a light-present condition and develops a camera-video pulse (FIG. 4) for each of the three scans. In this example, three light-present camera-video pulses (one shown) have been developed in response to the presence of a single hole. The next successive scan line, which is scan line 61, then passes adjacent to but not over the hole 40*a* whereby the camera 52 does not sense any light at this location. This represents a no-light condition.

Since the camera 52 is not moving, each of the sensing elements within the image sensor will be monitoring successive increments of the laminate 32 along a longitudinal path thereon. For example, a given sensing element would be positioned in alignment with the centerline 62 which passes through the hole 40*a* in FIG. 3. When each of the scan lines 58, 59, 60 and 61 intersects the centerline 62, the control circuit within the camera 52 conditions a given sensing element to sense the presence of light if there should be any. Sensing elements positioned adjacent to the given sensing element could also sense light from the same hole but, perhaps, to a lesser degree due to the small size of the hole. The camera-video pulse, which is an analog pulse, is developed and represents a combined pulse derived from the light sensed by the given and adjacent sensing elements. The time required for one complete scan cycle, including retrace time, is represented by 1,056 successive pulses of the 1 MHz clock signal. Consequently, 1,024 of the clock pulses condition successive ones of the 1,024 sensing elements during the scan cycle while the remaining 32 clock pulses occur during a reset mode of the camera 52.

As noted before, the output rate of the camera 52 is at one-half the frequency of the camera sync clock signal of 1 MHz. Therefore, the output data rate of the camera 52 is 500 KHz. In order to synchronize the timing of the system 46, the oscillator 56 provides the clock signal of 500 KHz to some of the components of the system 46 as illustraed in FIG. 2.

In response to light sensed by the sensing elements, the camera-video pulse is developed by the camera 52 and is coupled to a video amplifier, designated generally by the numeral 64. The video amplifier 64 then provides an output video pulse which is coupled to a delay-and-compare circuit, designated generally by the numeral 66. A representation of the video pulse is illustrated in FIG. 4.

Figure 4:
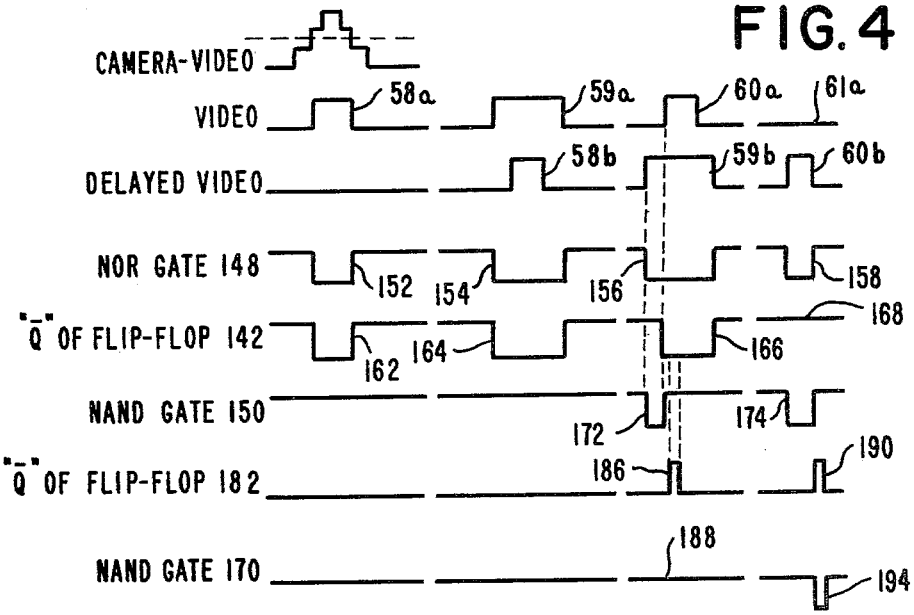
FIG. 4 is a waveform timing diagram illustrating the timing relationship between various pulses generated to provide the count of a single hole.

Referring to FIGS. 3 and 4, pulses 58*a*, 59*a* and 60*a* represent the video pulses developed in response to light sensed at hole 40*a* during scan lines 58, 59 and 60, respectively. The amount of light sensed during scan lines 58 and 60 is less than that sensed during scan line 59 due to the fact that scan line 59 passes through the center or larger portion of the hole 40*a*. Consequently, the pulse width of pulses 58*a* and 60*a* are less than the pulse width of pulse 59*a*. Also, there is no light sensed at centerline 62 during scan line 61. Therefore, no pulse appears at 61*a* of the video line of FIG. 4.

The video pulses 58*a*, 59*a* and 60*a* are fed to the delay-and-compare circuit 66 and are initially delayed for a period equal to the time for one scan cycle. This can be measured, for example, from the point where scan line 58 crosses the centerline 62 to the point when scan line 59 crosses the centerline. Thus, as illustrated in FIG. 4, pulse 58*b* represents delayed pulse 58*a* and occurs coincidentally with the next developed video pulse 59*a*. The delay effected within the delay-and-compare circuit 66 has the effect of shifting the hole 40*a* to a position as shown in phantom in FIG. 3.

The video pulses 58*a*, 59*a* and 60*a* as well as the delayed pulses 58*b*, 59*b* and 60*b* are processed within the delay-and-compare circuit 66 to provide an output count pulse only after the scan line 61 has passed the area adjacent to the hole 40*a* and no light was sensed by the camera 52. Point 68 on scan line 61 represents the point in time at which the count pulse is developed by the delay-and-compare circuit 66.

The count pulse is then coupled to a counter-comparator circuit, designated generally by the numeral 70. The counter-comparator circuit 70 includes facilities for establishing the preset count by manual adjustment. The preset count represents the desired number of holes 40*a*, 40*b* and 40*c* and slots 42*a* and 42*b* within each circuit section of the laminate 32. As the count pulses enter the counter-comparator circuit 70, they are processed through a counter portion of the circuit to provide an actual hole count which is compared with the preset count within a comparator portion of the circuit. Also, visual-count displays provide a final hole count for each circuit section of the laminate 32. If the actual count and the preset count compare favorably, a visual indication is provided and the hole-punching operation continues.

If the actual count does not compare favorably with the preset count, a fault signal is developed by a fault signalling portion of the circuit 70 and represents that a circuit section having one or more missing or extra holes has been detected. The fault signal is then coupled to a counter-reset circuit designated generally by the numeral 72. The counter reset circuit 72 includes facilities for manually presetting a count representing the number of successive circuit sections with missing holes which will render the entire roll unacceptable. The count of the fault signal is compared with the preset count and if the preset count is reached, the counter reset circuit develops an alarm signal which is coupled to an alarm circuit designated generally by the numeral 74. Upon reception of the alarm signal, the alarm circuit 74 controls the sounding of an alarm and sends a "stop" signal to the punch press 44 to stop the punching operation.

Figure 11:
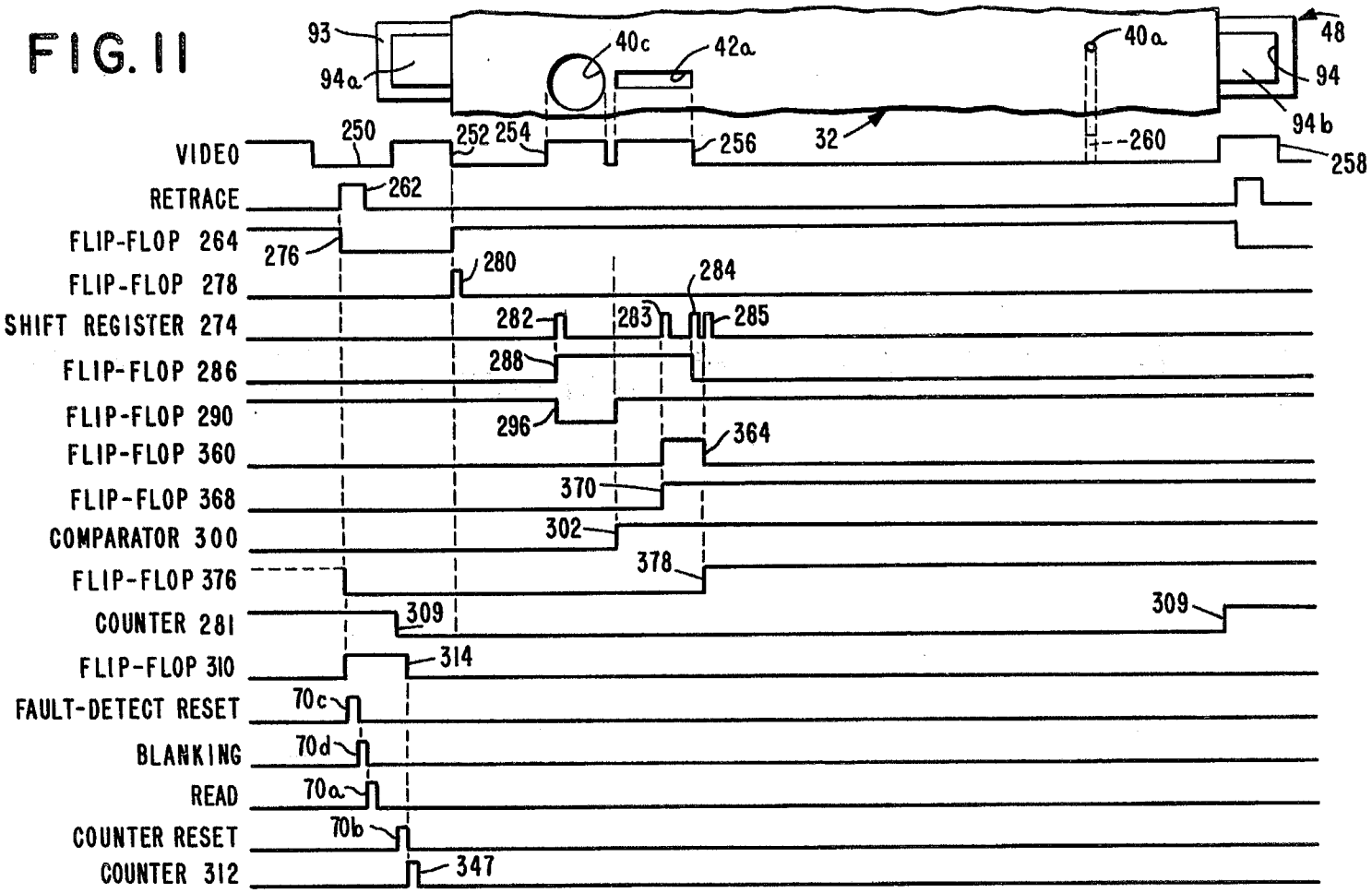
FIG. 11 is a waveform timing diagram showing the relationship between various pulses applied to and developed in the counter reset circuit of FIGS. 10A and 10B.

The counter reset circuit 72 also receives an inverted video pulse from the video amplifier 64 and a count pulse from the delay-and-compare circuit 66. During the period when the camera 52 is in the resetting mode to begin a new scan, a retrace signal is developed and fed to a retrace amplifier designated generally by the numeral 76. This signal is amplified and also fed to the counter reset circuit 72. This combination of signals being fed to the counter reset circuit 72, in combination with the 500 KHz clock signal, controls facilities within the circuit to provide, as represented in FIG. 11, a "read" pulse 70*a*, a "counter reset" pulse 70*b*, a "fault-detect reset" pulse 70*c* and a "blanking" pulse 70*d* which are coupled to the counter-comparator circuit 70.

When the scanning of a given circuit section of the laminate 32 has been completed, the "read" pulse 70*a* is developed by the counter reset circuit 72 and signals the counter-comparator circuit 70 to produce the comparison results between the actual hole count and the preset count as discussed above. The "read" pulse 70*a* also controls the visual-count displays to provide a read-out of the actual hole count.

When the comparison results have been "read," the "counter reset" pulse 70*b* is coupled to the counter-comparator circuit 70 to reset the counter portion in preparation for the counting of the holes of the next circuit section of the laminate 32. Also, the "fault-detect reset" pulse 70*c* is coupled to the counter-comparator circuit 70 to reset the fault signalling portion in the event that this portion had been activated.

During the period when the camera 52 is in the retracing mode, the "blanking" pulse 70d is fed to counter-comparator circuit 70 to momentarily turn off the visual-count displays to provide visual indication that the system 46 is functioning properly.

Power Supply and Control Circuit 54

Figure 5:
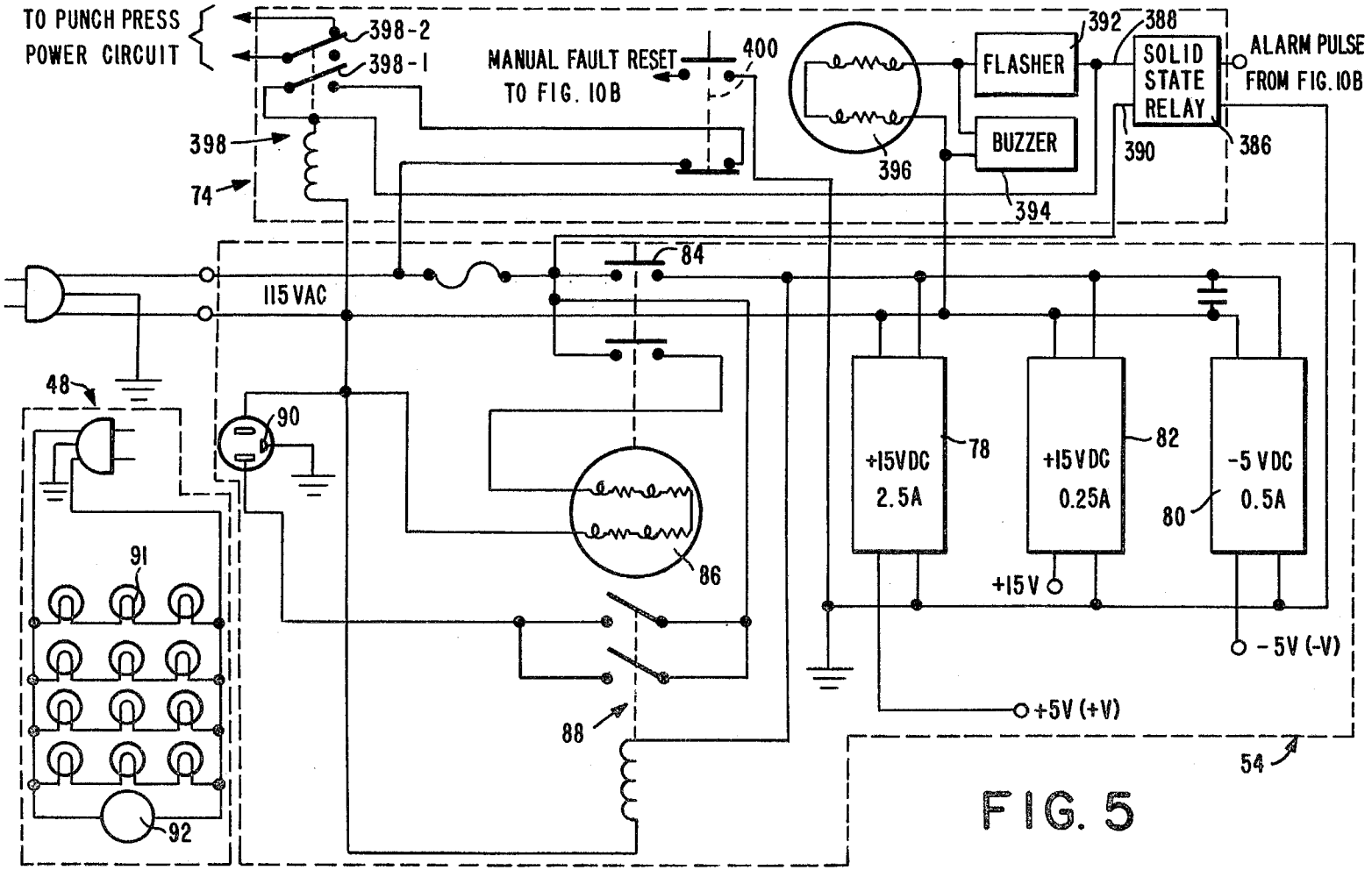
FIG. 5 is a schematic of a power supply, light source and alarm circuit for the system of FIG. 2.

Referring now to FIG. 5, the power supply and control circuit 54 includes a D.C. power supply 78 which provides five volts, two and one-half ampere output. The power supply 78 is available from the Acopian Corporation of Easton, Pennsylvania as Model Number 5EB250. The circuit 4 also includes a D.C. power supply 80 which provides five volts, one-half ampere output. The power supply 80 is also available from the Acopian Corporation as Model Number 5E50A. Further, the circuit 54 includes a D.C. power supply 82 which provides fifteen volts, one-quarter ampere output. The power supply 82 is available from the Acopian Corporation as Model 15EB20. Each of the power supplies 78, 80 and 82 is connectable to an external source of 115 volts A.C. through a power switch 84. Also, a lamp 86 is operated to indicate that the external power is being applied to the power supply and control circuit 54.

The negative output lead of the power supply 78 is connected to a common ground for the system 46. The positive and negative outputs of the power supply 78 are connected to provide a positive five-volts D.C. which is represented as "+V" throughout the remaining FIGS. of the system 46.

The positive output of the power supply 80 is connected to ground to provide a negative five-volts D.C. which is represented as "−V" throughout the remaining FIGS. of the system 46.

The power supply 82 provides a fifteen-volts D.C. source for the camera 52 and is not otherwise used in the system 46.

When the switch 84 is closed, a relay 88 is operated to close the related contacts and facilitate application of 115 volts A.C. to an outlet 90. Outlet 90 provides power access for the lamp source 48 represented by a bank of type ELH lamps 91 which are manufactured by and available from the General Electric Company. A cooling fan 92 is provided for the lamp source 48. As illustrated in FIG. 1, the lamp source 48 is contained within a housing 93 which is formed with a translucent-covered, light-emitting opening 94. As viewed from the underside of the laminate 32, the opening 94 is sufficiently long to extend beyond opposite edges of the laminate so that light from the source 48 is emitted on opposite sides of the laminate.

Oscillator 56

Figure 6:
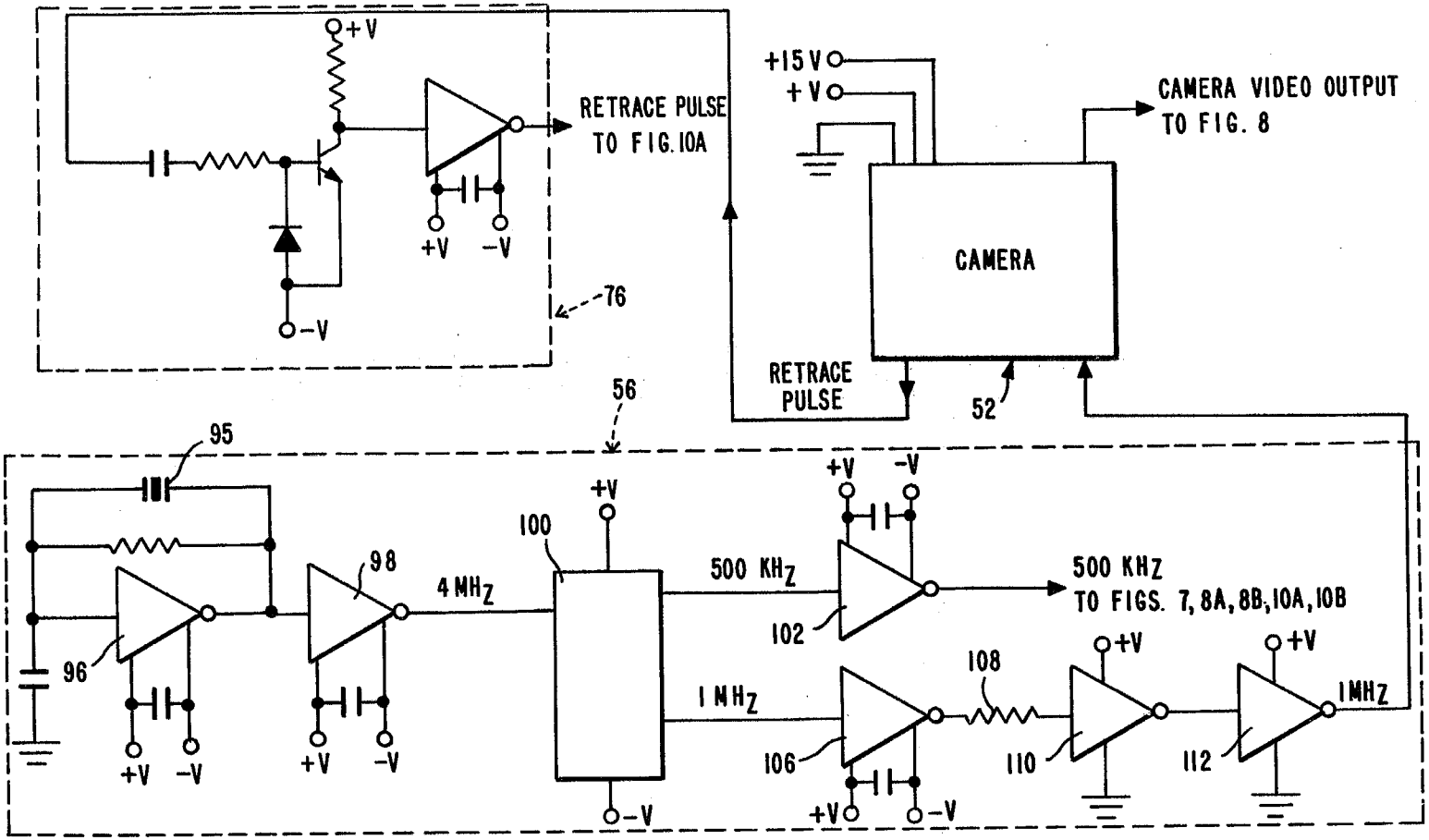
FIG. 6 is a schematic of an oscillator which is a part of, and which provides the necessary timing pulses for various circuits of, the system of FIG. 2 and of an amplifier circuit which responds to each scan by the image sensor of FIG. 2 and provides a reset pulse within the system.

Referring to FIG. 6, the oscillator 56 includes a 4 MHz crystal 95 which is connected across an inverting buffer 96 to provide a 4 MHz signal form the output of the combination thereof. The inverting buffer 96 is of the type identifed as an MC14049 hex inverter-buffer and described in a publication entitled "McMOS Integrated Circuits Data Book," published by Motorola Incorporated with first-edition publication in December, 1973. Hereinafter, this publication will be referred to as the "Data Book."

The 4 MHz signal is coupled through another inverting buffer 98, of the same type as buffer 96, and is fed to a seven-stage ripple counter 100 identified in the Data Book as an MC14024 counter. The counter 100 is used as a divider and provides one clock signal at 500 KHz and another clock signal at 1 MHz. The 500 KHz clock signal is coupled through an inverting buffer 102, of the same type as buffer 96, to one output line of the oscillator 56. The 1 MHz clock signal is coupled through an inverting buffer 106, of the same type as buffer 96. It is noted that all of the inverting buffers 96, 98, 102 and 106, and the counter 100, operate on a ten-volts, CMOS logic system as represented by the connection of each buffer and the counter between +V and −V.

Since the camera 52 requires a TTL-compatible signal source at five volts, and the oscillator 56 operates at ten volts, the 1 MHz clock signal is fed through a dropping resistor 108 to drop the signal to five volts. The 1 MHz clock signal is then coupled through two TTL-inverting buffers 110 and 112 to provide sufficient power for the clock signal of five volts to pass through a coaxial cable (not shown) to the camera 52. While the first buffer 110 would probably be sufficient, the second buffer 112 is included in combination with the first buffer to provide double inversion of the 1 MHz clock signal and thereby insure that this clock signal is in phase with the 500 KHz clock signal. As noted, the 1 MHz clock signal is then fed to the camera 52. The buffers 110 and 112 are of a type identified as Dual Buffer type 932 manufactured by Fairchild Semiconductor.

Video Amplifier 64

Each time light is sensed by the camera 52, a camera-video pulse (FIG. 4) is developed and is fed through a coaxial cable (not shown) to the video amplifier 64.

Figures 8, 8B:
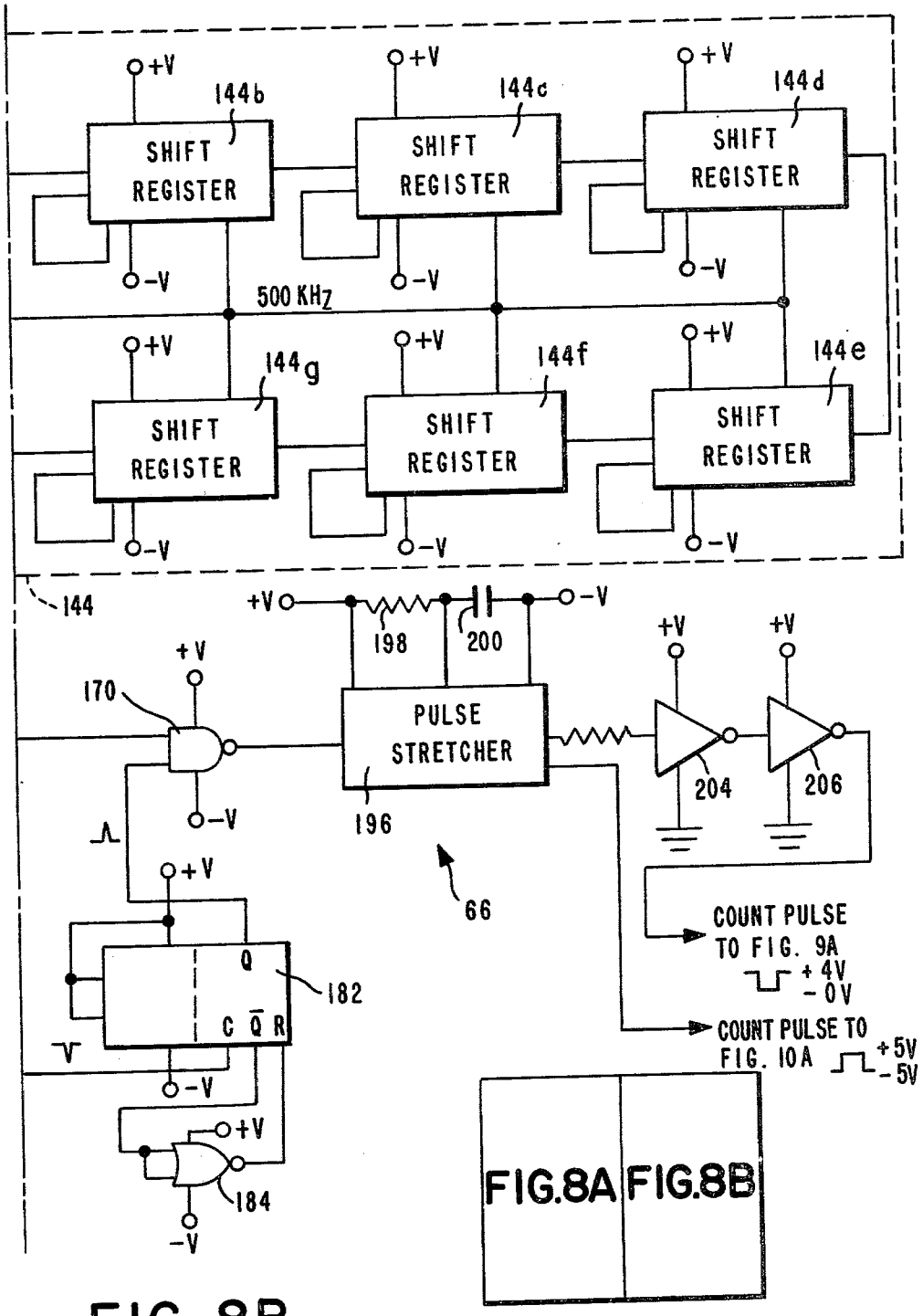
FIG. 8 is a view showing a combination arrangement of the schematic of FIGS. 8A and 8B.
FIGS. 8A and 8B when combined as shown in FIG. 8 show a schematic of a delay-and-compare circuit which receives pulses from the video amplifier of FIG. 7 and develops an output pulse when a hole count is to be provided in accordance with certain principles of the invention.

Referring to FIG. 8, the video amplifier 64 operates at a ten volt D.C. level and includes an operational amplifier 114 which provides the input circuit for the amplifier. Operational amplifier 114 is manufactured by Precision Monolithics, Inc., Santa Clara, California, as their type OP-02AY. The camera-video pulse is fed to input line 116 and is represented as a negative-going pulse extending from positive 1.5 volts to positive 1.0 volts. Another input line 118 is connected to ground within the camera 52 by way of the shielded portion of the coaxial cable which couples the camera to the video amplifier 64. The input line 118 is also connected to ground within the system 46 so that the system ground is common with the camera ground.

The camera-video pulse is fed to the video amplifier 64 where the operational amplifier 114 develops a one-volt, positive-going pulse extending from negative 0.4 volt to positive 0.6 volt. The one-volt pulse is fed to one input 120 of a comparator 122 and is clamped at the negative 0.4 volt level by a diode 124. Comparator 122 is also manufactured by Precision Monolithics, Inc. as their type CMP-01. Another input 126 of the comparator 122 has a constant zero level voltage applied thereto whereby, when compared with the negative 0.4 volt level on input 120, the output of the comparator is a steady, positive 5 volts. When the positive 0.6 volt pulse is fed on input 120 to the comparator 122, a negative-going pulse of ten volts is developed and extends between positive 5 volts and negative 5 volts.

The ten-volt pulse developed by the comparator 122 is fed to the data (D) input of a flip-flop 128 which sets the flip-flop. Also, the 500 KHz clock signal is fed from the oscillator 56 (FIG. 6) through input line 130 to the clock (C) input of flip-flop 128. When flip-flop 128 is set, the "$\overline{Q}$" output is a positive-going pulse of ten volts between negative five volts and positive five volts on line 132 and represents the video pulse as illustrated on the "video" line of FIG. 4. By feeding both the output of the comparator 122 and the 500 KHz clock signal into flip-flop 128, the system 46 assures that the video pulse is synchronized with the 500 KHz clock signal. The "Q" output of flip-flop 128 provides an output pulse which is an inverted version of the video pulse referred to as the inverted video pulse.

The flip-flop 128 is of the type identified in the Data Book as an MC14013 dual type D flip-flop.

Delay and Compare Circuit 66

Figure 8A:
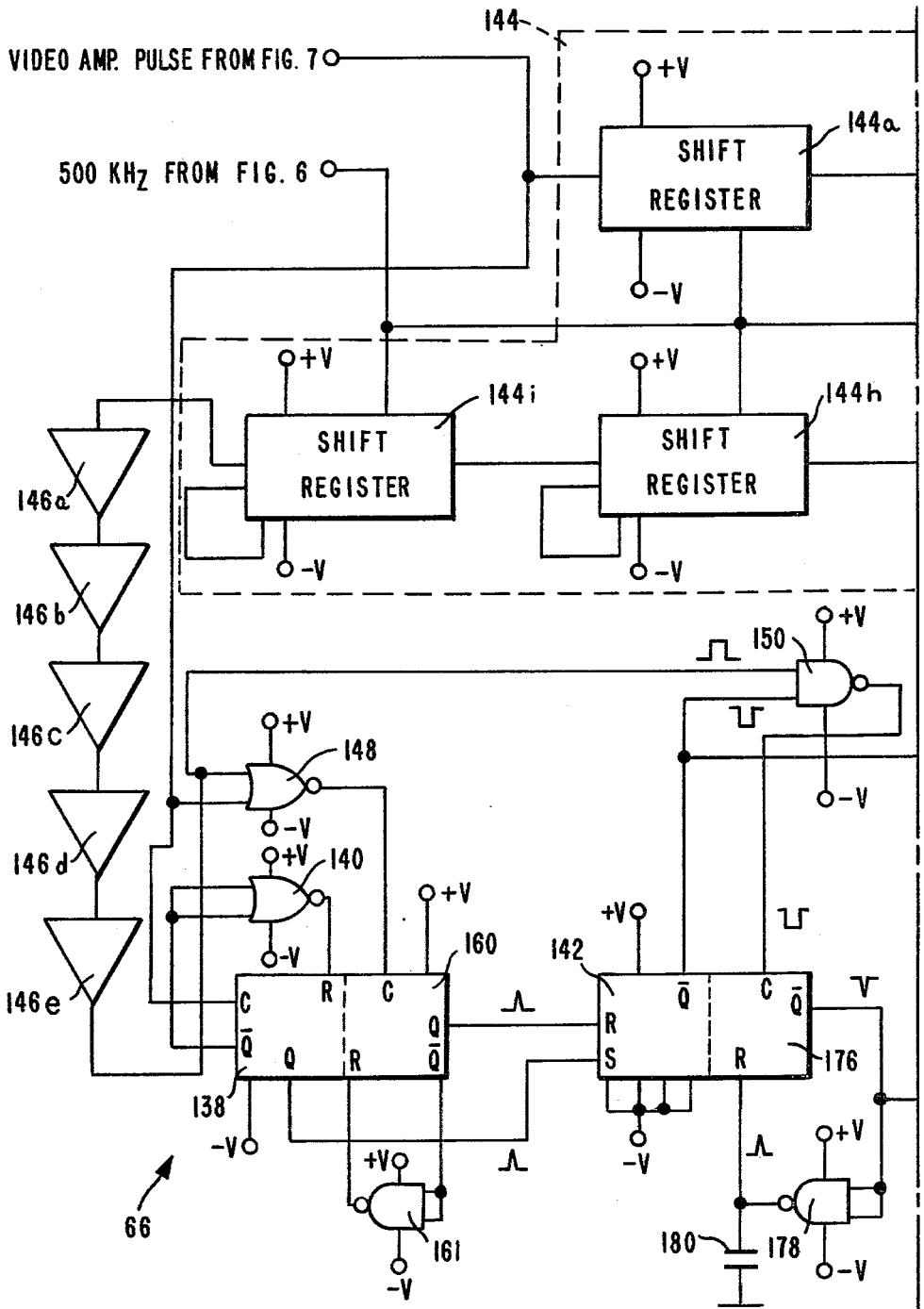

Referring to FIGS. 8A and 8B, the video pulse (FIG. 4) is fed from output line 132 (FIG. 8) to input line 136 of the delay-and-compare circuit 66 which operates on a CMOS logic system of ten volts except where specified otherwise.

The video pulse is fed to the clock (C1) input of a flip-flop 138 to set the flip-flop whereby a positive-going pulse appears at the "Q" output thereof. At the same time, a negative-going pulse appears at the "$\overline{Q}$" output of the flip-flop 138 which is fed through an inverter 140 to the reset (R1) input of the flip-flop. This resets the flip-flop 138 whereby the pulse at the "Q" output goes negative. The resultant pulse at the "Q" output is a spike or trigger pulse. The spike pulse is fed to the set (S1) input of a flip-flop 142 to set the flip-flop. When the flip-flop 142 is set, a negative going pulse appears at the "$\overline{Q}$" output of the flip-flop.

The flip-flops 138 and 142 each form one half of a dual type identified in the Data Book as an MC14013 dual type D flip-flop. The inverter 140 is identified in the Data Book as an MC14001 quad 2-input "NOR" gate.

The video pulse is also fed to a 1056-bit shift register 144 which includes nine, identical, series-connected shift registers **144*a*–144*i*. The shift registers 144*a*–144*i* are identified in the Data Book as dual 64-bit static shift registers. The 500 KHz clock pulse is fed to each of the shift registers 144*a*–144*i* to insure synchronous operation of the delay-and-compare circuit 66. The 1056-bit shift register 144 represents the time for one scan cycle of the camera 52** and, consequently, delays any through-put video pulses for a period equal to one scan cycle.

The delay accomplished by the shift register 144 is illustrated in FIG. 4 where the video pulses **58*a*, 59*a* and 60*a* are inputs to the shift register and the delayed video pulses 58*b*, 59*b* and 60*b*** are the same pulses delayed by the time of one scan cycle.

The delayed output of the shift register 144 is fed through five series-connected, non-inverting buffers **146*a*–146*e* which provide a slight additional delay to insure that the delayed video pulse is delayed for a period at least equal to the time for one scan cycle. The buffers 146*a*–146*e* are identified in the Data Book as MC14050 noninverting hex buffers. The output of buffer 146*e* is fed to one input of a NOR gate 148 and one input of a NAND gate 150**.

The video pulses are fed directly to another input of the NOR gate 148 whereby the output of the gate, as represented in FIG. 4, is an inverted version of the input pulses or the shift register output. Referring further to FIG. 4, when the video pulse **58*a* is fed to the NOR gate 148, there is no delayed pulse from the shift register 144. Consequently, output pulse 152 of NOR gate 148 will be an inverted version of pulse 58*a* since there is delayed video from the shift register at this time. When the video pulse 59*a* and delayed video pulse 58*b* are fed to NOR gate 148, pulse 59*a* encompasses pulse 58*b* and the resulting output of NOR gate is pulse 154. In a similar fashion, pulse 156 appears at the output of NOR gate 148 when pulse 59*b* and 60*a* are applied to the gate. When delayed video pulse 60*b* occurs, there is no pulse appearing at the output of the video amplifier 64 because no light was sensed at point 61*a* during the scan of line 61 (FIG. 3) as previously described. Therefore, pulse 60*b* is the only input to NOR gate 148 at this time and the output of the gate is pulse 158 which is an inverted version of pulse 60*b*. NOR gate 148 is of the same type as NOR gate 140**.

The negative output pulses 152, 154, 156 and 158 of NOR gate 148 are fed to the clock (C) input of a flip-flop 160 which is of the same type as flip-flop 138. However, flip-flop 160 will not be set until there is a positive-going transition in the pulse being applied thereto. For example, when pulse 156 (FIG. 4) is at its trailing edge, and is therefore positive going, flip-flop 160 is set and a positive-going pulse appears at the "Q" output thereof. At the same time, a negative-going pulse appears at the "$\overline{Q}$" output of flip-flop 160 and is fed through an inverter 161 to the reset (R) input of the flip-flop to reset the flip-flop. At this time, the "Q" output of flip-flop 160 goes negative and a postive-going spike or trigger pulse is developed. The spike pulse is fed to the reset (R) input of the flip-flop 142 to reset the flip-flop whereby the "$\overline{Q}$" output goes positive. Thus, the setting of flip-flop 142 by the leading edge of the video pulses through flip-flop 138, and the resetting of flip-flop 142 by the trailing edge of the output pulse of NOR gate 148 through flip-flop 160, results in negative pulses 162, 164 and 166 (FIG. 4) appearing at the "$\overline{Q}$" output of flip-flop 142.

Referring to FIG. 4, the leading edge of video pulse **58*a* results in the formation of the leading edge of pulse 162 while the trailing edge of pulse 152 of NOR gate 148 results in the trailing edge of pulse 162 to thereby form the negative pulse 162. Negative pulses 164 and 166 are formed in a similar manner. Since there is no pulse occurring at point 61*a* (FIG. 4) of the video line, flip-flop 138 is not set and consequently flip-flop 142 is not set. Therefore, there is no negative output pulse at point 168 on the output line of flip-flop 142**.

Referring again to FIGS. 8A and 8B, as the negative pulses 162, 164 and 166 appear at the "$\overline{Q}$" output of flip-flop 142, they are fed to the NAND gate 150 and to another NAND gate 170. As noted before, the delayed video pulses **58*b*, 59*b* and 60*b* are also fed to the NAND gate 150. When either input to the NAND gate 150 is negative, the output of the gate will appear positive. When both inputs to the NAND gate 150** are positive, the output will appear negative.

Referring to FIG. 4, the delayed video line is normally at a negative level with positive pulses **58*b*, 59*b* and 60*b*. Thus, the output of NAND gate 150 could only be negative during the occurrence of pulses 58*b*, 59*b* and 60*b*. The pulse line of the "$\overline{Q}$" of flip-flop 142 is normally positive with negative-going pulses 162, 164 and 166. Therefore, the output of NAND gate 150 could only be negative during those times when there are no pulses present along the pulse line of the "$\overline{Q}$" of flip-flop 142. This condition occurs for the first time during the occurrence of a leading portion of pulse 59*b* and immediately before the occurrence of pulse 166**.

This results in a negative pulse 172 which appears at the output of NAND gate 150. The condition occurs again during the occurrence of pulse 60*b*. At this time, there are no pulses at the "$\overline{Q}$" output of flip-flop 142, represented at point 168 of FIG. 4, whereby the output is positive. The result is a negative pulse 174 at the output of the NAND gate 150.

Referring to FIGS. 8A and 8B, the negative pulses 172 and 174 are fed to the clock (C) input of a flip-flop 176 which is set by both negative pulses to provide a negative-going pulse at the "$\overline{Q}$" output thereof. This negative-going pulse is fed through an inverting NAND gate 178 to the reset (R) input of flip-flop 176 to reset the flip-flop. A capacitor 180 is connected between the output of the NAND gate 178 and ground to provide a delay in the resetting of the flip-flop 176. This results in a pulse of short duration which appears at the "$\overline{Q}$" output of the flip-flop 176 and is fed to the clock (C) input to a flip-flop 182 to set flip-flop 182. NAND gates 150 and 170, and inverters 162 and 178, are of the type identified in the Data Book as MC14011 quad 2-input "NAND" gate. Flip-flops 176 and 182 are of the same type as flip-flop 138.

When flip-flop 182 is set, a positive-going pulse appears at the "Q" output and a negative-going pulse appears at the "$\overline{Q}$" output. The negative-going pulse is fed through an inverter 184, which is the same type as inverter 140, to the reset (R) input of flip-flop 182 to reset the flip-flop. This results in a positive-going spike 186 (FIG. 4) at the "Q" output of flip-flop 182 which is fed to one input of NAND gate 170. As noted before, the "$\overline{Q}$" output pulses 162, 164 and 166 of flip-flop 142 are also fed to the NAND gate 170. Both inputs to the NAND gate 170 must be positive before a pulse appears at the output of the gate. Anytime the negative pulses 162, 164 and 166 are fed to the NAND gate 170, the pulses inhibit the gate from providing an output pulse.

Referring to FIG. 4, when positive spike 186 is fed to the NAND gate 170, negative pulse 166 is also being fed to the gate and the gate is inhibited from providing an output as represented at point 188 on the pulse line for the output of the gate. The delay provided by capacitor 180 delays the developement of the positive spike outputs, such as spike 186, of the "$\overline{Q}$" output of flip-flop 182 to insure that the spikes occur simultaneously with the negative-going pulses of the "$\overline{Q}$" output of flip-flop 142 should there be such an output.

When spike 190, which is generated in the same manner as spike 186, appears at the "Q" output of flip-flop 182 and is coupled to NAND gate 170, the "$\overline{Q}$" output of flip-flop 142 is positive as indicated at point 168 on the pulse line of FIG. 4. Since both inputs to NAND gate 170 are now positive, a negative count pulse 194 (FIG. 4) appears at the output of the NAND gate and represents the counting of the hole 40*a* (FIG. 3). Note that during the time when count pulse 194 is occurring, there is no video pulse. Thus, the counting of hole 40*a* (FIG. 3) actually occurs during the time of scan line 61 at point 68 which is the first scan line on which a "no-light" condition occurs after light was sensed on at least the immediately previous scan line, for example scan line 60. By use of the delay-and-compare technique employed by the delay-and-compare circuit 66 and by the system 46, whereby preceding video pulses generated in response to a given hole are delayed and compared with the time frame for the next incoming video pulse generated by the same hole, only one count pulse 194 is generated for each hole regardless of the number of times light is sensed over successive scan lines for the same hole.

Figures 10, 10A, 10B:
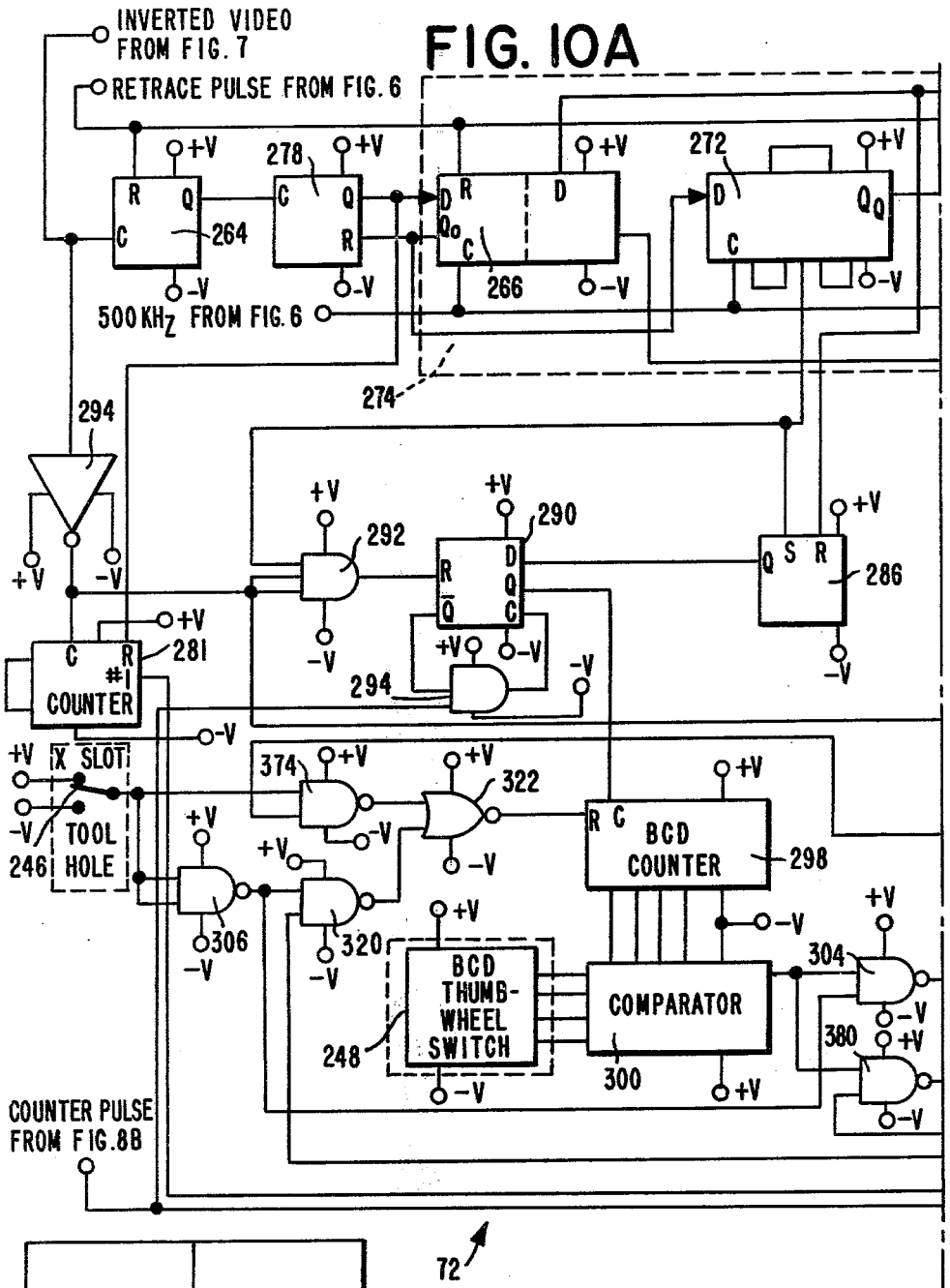
FIG. 10 is a view showing a combination arrangement of the schematic of FIGS. 10A and 10B.
FIGS. 10A and 10B when combined as shown in FIG. 10 show a schematic of a counter reset circuit which resets the counter-comparator circuit of FIGS. 9A and 9B in accordance with certain principles of the invention.
Figure 10B:
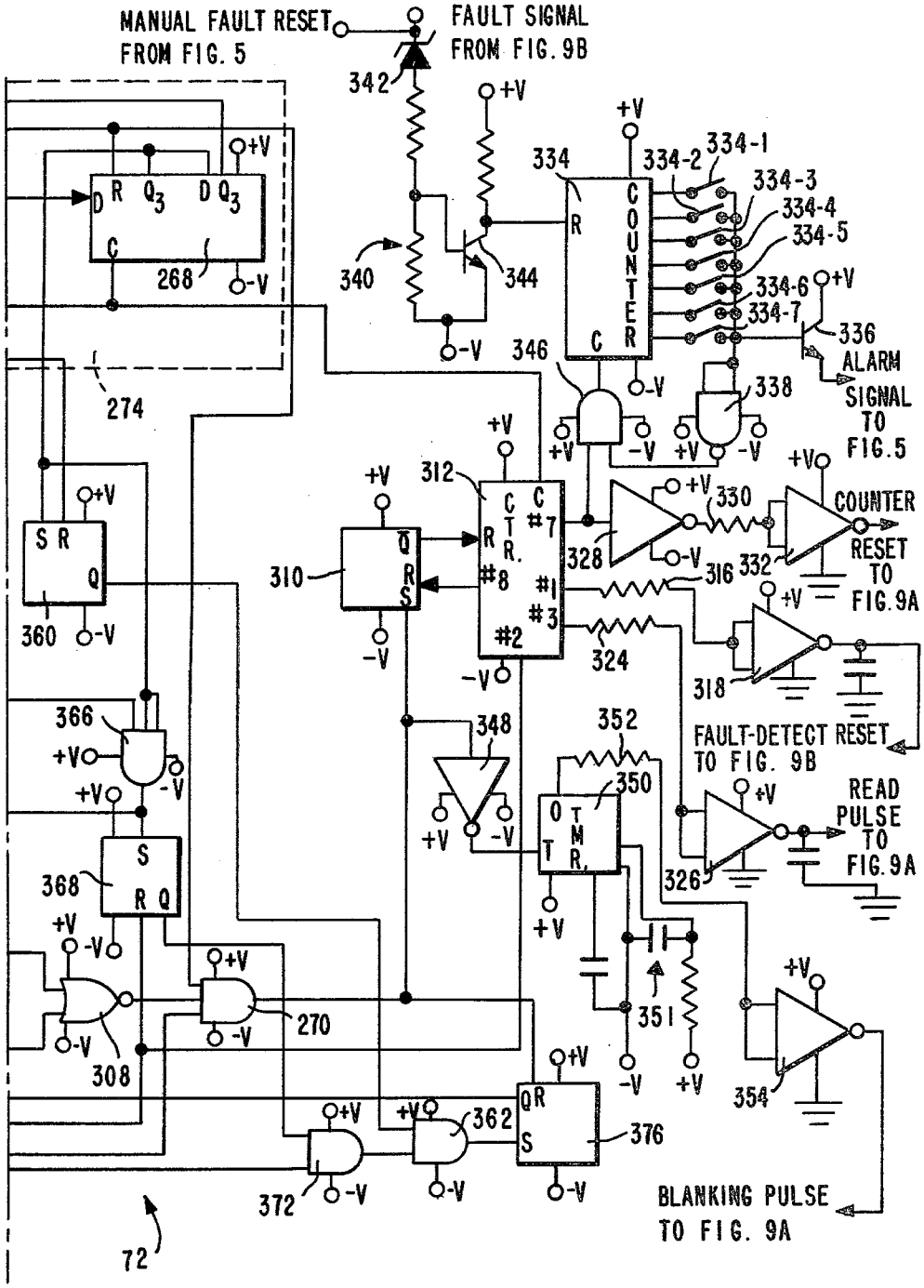

The count pulse 194 is fed to a pulse stretcher 196 which is identified in the Data Book as an MC14528 multivibrator. A resistor 198 and a capacitor 200 are connected to the pulse stretcher 196 and provide an RC time constant which establishes the pulse width of the pulses appearing at the "Q" and "$\overline{Q}$" outputs thereof. The "$\overline{Q}$" output is fed through a dropping resistor 202 and through two inverting buffers 204 and 206 to prepare the stretched count pulse for the TTL logic system of five volts employed by the counter-comparator circuit 70 (FIGS. 2 and 10). The "Q" output of the pulse stretcher 196 is fed to the counter reset circuit 72 (FIGS. 2 and 11) which operates on the ten-volt CMOS logic system. The buffers 204 and 206 are of the same type as buffers 110 and 112 (FIG. 6).

Referring to FIG. 3, the solid circle represents the hole 40*a* while the phantom circle represents the same hole delayed as explained above. As the left perimeter of the solid circle is crossed on each of the scan lines 58, 59 and 60, light is sensed and video pulses are developed which terminate when the right perimeter of the solid circle is crossed. However, due to the trailing one-third of the delayed pulse 59*b*, which extends beyond the trailing edge of video pulse 60*a*, the delay-and-compare circuit 66 is effectively still providing indication of light being sensed as indicated by cross-hatched area 207.

Counter-Comparator Circuit 70

Figures 9, 9A, 9B:
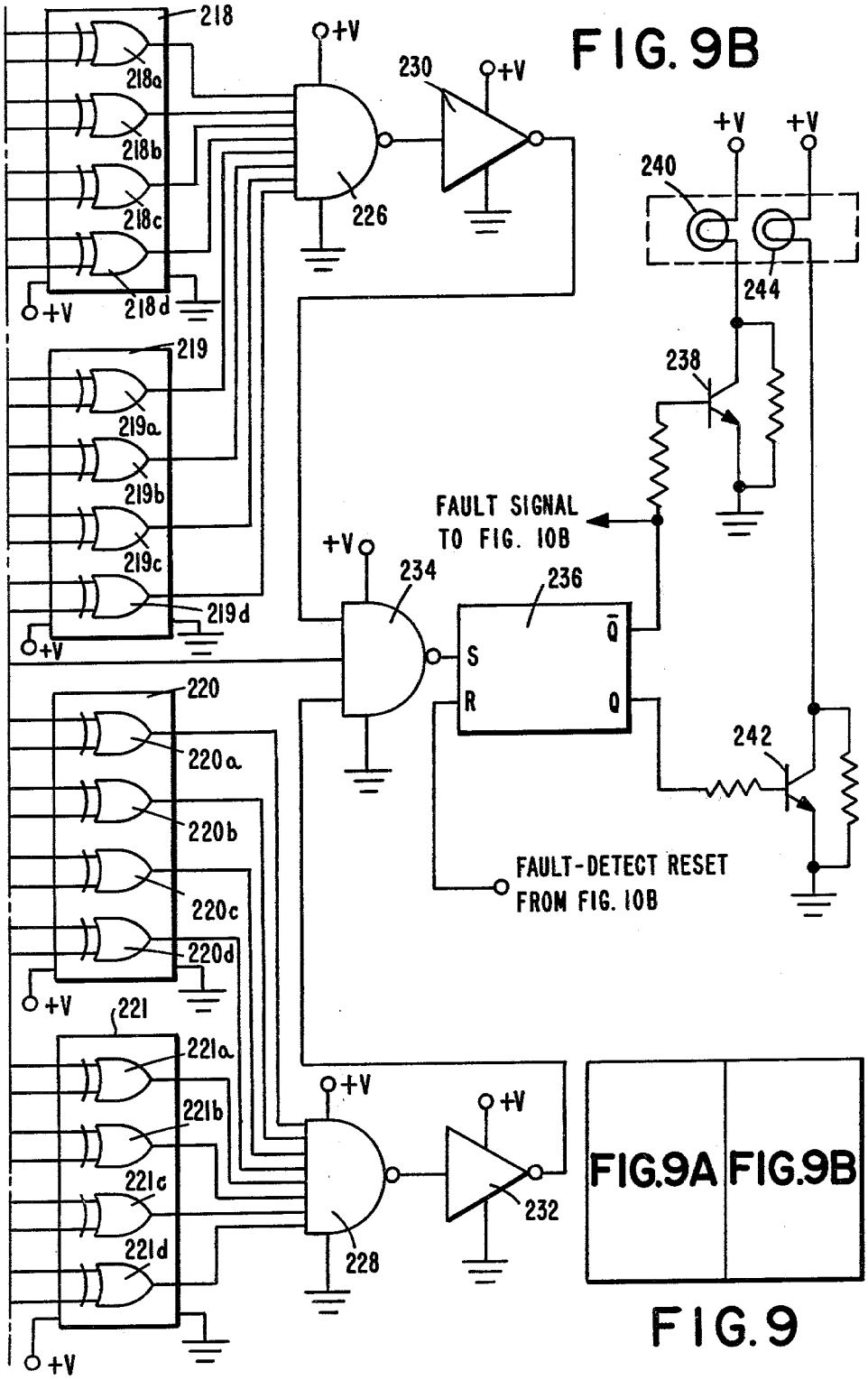
FIG. 9 is a view showing a combination arrangement of the schematic of FIGS. 9A and 9B.
FIGS. 9A and 9B when combined as shown in FIG. 9 show a schematic of a counter-comparator circuit for visually displaying the hole count and comparing this count with a preset count.
Figure 9A:
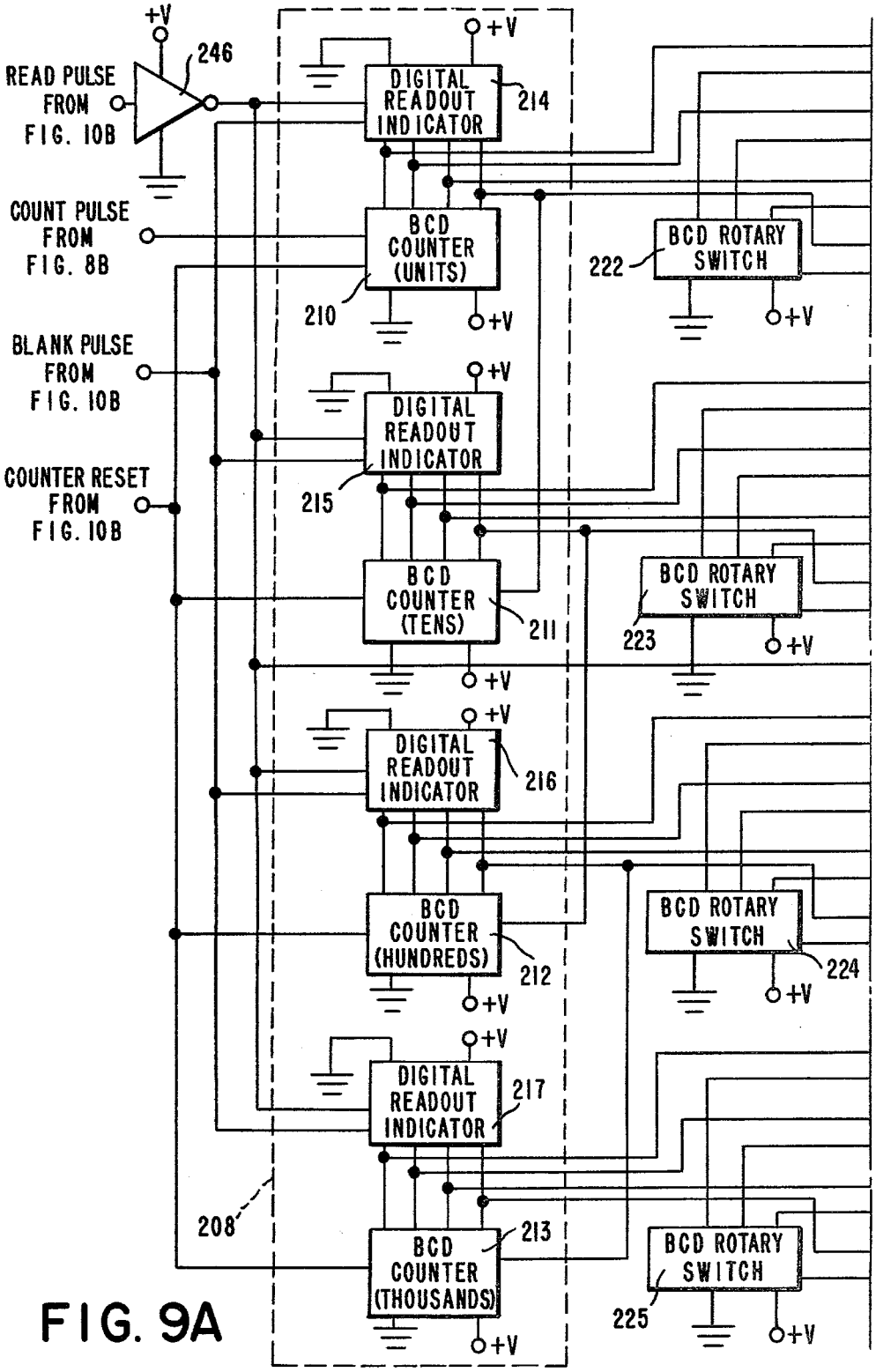

Referring to FIGS. 9A and 9B, the counter-comparator circuit 70 includes a counter portion 208. The counter portion 208 includes four binary-coded-decimal counters 210–213 which are connected in series to count any number from 0 through 9999. The counters 210–213 function as units, tens, hundreds and thousands counters, respectively, and are manufactured by Motorola, Incorporated, as their Model MC7490. The outputs of the four counters 210—213 are connected to four digital-readout indicators 214–217, respectively, which are manufactured by Dialight Company of Brooklyn, N.Y., as their Model 749–0904. The output of the counters 210–213 are also connected to four comparators 218–221, respectively. Four binary-coded-decimal, rotary switches 222–225 have outputs also connected to the four comparators 218–221, respectively. The switches 222–225 are manufactured by Digitran Company of Pasadena, Calif., as their Model 311–4.

Each of the comparators 218–221 includes four exclusive OR gates which are identified within each comparator by the comparator number and the letters a–d. For example, the OR gates of comparator 218 are numbered 218*a*–218*d*. The OR gates are manufactured by Motorola, Incorporated, as their type MC7486. The outputs of the comparators 218 and 219 are fed to a NAND gate 226 while the outputs of the comparators 220 and 221 are fed to a NAND gate 228. The outputs of the NAND gates 226 and 228 are fed through two inverting buffers 230 and 232, respectively, and into a NAND gate 234. The NAND gates 226 and 228 are manufactured by Motorola, Incorporated, as their type MC7430. The inverting buffers 230 and 232 are manufactured by Fairchild Semiconductor as their type 936. The NAND gate 234 is also manufactured by Fairchild Semiconductor as their type 962.

The output of the NAND gate 234 is normally positive and is fed to the set (S) input of a flip-flop 236 which normally produces a negative "$\overline{Q}$" output and a positive "Q" output. The negative "$\overline{Q}$" output is fed to the base of a transistor 238 to bias the transistor into the nonconducting state. This prevents the connecting of ground to a red or "failure" lamp 240. The flip-flop 236 is manufactured by Motorola, Incorporated, as their type MC7470.

The positive "Q" output of the flip-flop 236 is fed to the base of a transistor 242 to bias the transistor into conduction. When the transistor 242 is conducting, ground is applied to a green or "pass" lamp 244 whereby the lamp is illuminated. Thus, normally the green lamp 244 is illuminated and the red lamp 240 is not illuminated.

Prior to the passing of the laminate 32 (FIG. 1) through the punch press 44 (FIG. 1) and adjacent to the light source 48, an operator reviews the code requirements and determines the total number of holes 40*a*, 40*b* and 40*c*, and slots 42*a* and 42*b*, that should be formed in each circuit section of the laminate. The operator then sets this hole count into the four rotary-switches 222–225. This is a preset count which is to be compared with the actual count of holes and slots in the laminate 32. The rotary-switches 222–225 are provided with visual read-out displays to show the preset count.

As the laminate 32 is moved past the light source 48 (FIG. 1), the camera 52 scans the moving laminate whereby an actual count of the holes 40*a*, 40*b*, 40*c* and slots 42*a* and 42*b* is made in the manner described hereinbefore. This actual count is fed from the output of the buffer 206 (FIG. 8B) into the units counter 210. As the count progresses, it may be shifted to the tens, hundreds and thousands counters 211–213 depending on the number of holes and slots being counted. The outputs of the counters 210–213 are continuously being fed to respective indicators 214–217. However, the indicators 214–217 are not registering, for readout, the incoming count pulses but are retaining the total count registered for the most recent complete circuit section examined by the camera 52.

The outputs of the counters 210–213 are also fed to the comparators 218–221, respectively, and are compared therein with the preset count of the switches 222–225. Assuming the correct number of holes and slots appear in the laminate 32 and have been counted, each of the exclusive OR gates of the comparators 218–221 will provide a positive output. These positive outputs are then fed to the respective NAND gates 226 and 228 whereby the normally positive outputs of the NAND gates 226 and 228 go negative. The negative outputs of the NAND gates 226 and 228 are inverted by the buffers 230 and 232, respectively, and the positive outputs thereof are fed to two inputs of the NAND gate 234. The buffers 230 and 232 are of the type identified as type 936 Hex Inverters manufactured by Fairchild Semiconductor. NAND gate 234 is of the type identified as type 962 Triple 3-input NAND gate manufactured by Fairchild Semiconductor.

At this time, the "fault-detect reset" pulse 70*c* (FIG. 11) is fed from the counter reset circuit 72 (FIGS. 2, 10A and 10B) to the reset (R) input of the flip-flop 236 to reset the flip-flop. The "$\overline{Q}$" output then goes positive and the "Q" output goes negative whereby transistor 242 is rendered nonconducting and the green lamp 244 starts to go off and transistor 238 is rendered conductive and the red lamp 240 starts to be illuminated.

An instant after the "fault-detect reset" pulse has completed its cycle, the "read" pulse 70*a* is fed from the counter reset circuit 72 to an inverting buffer 246. The output of the buffer 246 is a positive pulse which is fed to the indicators 214–217 whereby the indicators display the actual count stored in the counters 210–213 which can be visually compared with the read-out of the preset rotary switches 222–225 if desired. The positive pulse output of the buffer 246 is also fed to the remaining input of the NAND gate 234. Since positive pulses appear on the remaining two inputs to the NAND gate 234 due to the favorable comparison of the actual and preset counts, a negative output appears at the output of the NAND gate for the period of the "read" pulse 70*a*. When the "read" pulse 70*a* ceases, the output of the NAND gate 234 goes positive whereby the flip-flop 236 is again set to provide illumination of the green lamp 244 and the extinguishing of the red lamp 240.

Due to the close occurrence of the "fault-detect reset" pulse 70*c* and the "read"pulse 70*a*, the filaments of the red lamp 240 are not sufficiently heated for illumination before flip-flop 236 is again set. Similarly, the filaments of the green lamp 244 are not sufficiently cooled to extinguish the lamp. Therefore, due to the rapid resetting and setting of flip-flop 236 when a favorable comparison of actual and preset counts is made, the green or "pass" lamp 244 gives the appearance of continuous glow while the read or "fail" lamp 240 is not illuminated.

If any number of the holes 40*a*, 40*b* and 40*c*, and slots 42*a* and 42*b* are missing, the outputs of some of the comparators 218–221 will be negative where unfavorable comparisons are made. In this instance, one or both of the NAND gates 226 and 228 will be positive which is inverted by the buffers 230 and 232 and then fed to the inputs of NAND gate 234.

As noted before, the "fault-detect reset" pulse 70*c* is then fed to the reset (R) input of the flip-flop 236 to reset the flip-flop. Again, the red lamp 240 starts to become illuminated while the green lamp 244 starts to be extinguished. Soon thereafter, the "read" pulse 70*a* is fed to the counter-comparator circuit 70 which results in the application of a positive pulse to the remaining input of NAND gate 234. Since either, or both, of the remaining two inputs of NAND gate 234 are negative due to an unfavorable comparison of actual and preset counts, the output of NAND gate 234 remains positive. Since there is no transistion at the output of NAND gate 234, the flip-flop 236 is not set. Consequently, due to the resetting of flip-flop 236, the red, or "failure", lamp 238 is illuminated to indicate a failure and the green lamp 244 is extinguished. Also, a fault signal is fed from the "$\overline{Q}$" output of flip-slop 236 to FIG. 10B to register the failure. If desired, the unfavorable count comparison can be visually observed by the actual count on the digital read-out indicators 214–217 and the preset count on the rotary-switches 222–225.

It is noted that the actual counts are made for each twelve-inch section of the laminate 32 and that the two foregoing "pass" and "failure" examples each represent a twelve-inch circuit section. Further, the system 46 provides a single "failure" indication for any given circuit-section that fails regardless of the number of missing holes for that given circuit section.

Since flip-flop 236 was not set during the occurrence of the "read" pulse 70*a*, the red lamp 240 will remain illuminated during the entire period of counting for the next successive twelve-inch circuit section. Upon completion of the counting, the "fault-detect reset" pulse 70*c* is again applied to the reset (R) input of flip-flop 236. However, flip-flop 236 is already in the reset mode because it was not set during the previous "read" pulse 70a. Therefore, the red lamp 240 remains illuminated at this time. Then, immediately thereafter, the "read" pulse 70a is fed to the counter-comparator circuit 70. If a favorable count comparison has been made, flip-flop 236 is then set, the red lamp 240 is extinguished and the green lamp 244 is illuminated to indicate the favorable comparison. If the count comparison is unfavorable, the red lamp 240 remains illuminated to indicate the failure and the laminate 32 continues to move to begin the hole counting of the next successive twelve-inch circuit section.

Counter Reset Circuit 72

Referring to FIG. 1, the laminate 32 is formed with many holes 40a and 40b, which give the appearance of a random array of holes. However, each circuit code has an ultimate definitive pattern which is undetectable when the laminate 32 appears as illustrated in FIG. 1. Since each circuit section of the laminate 32 extends twelve inches along the length of 550 feet of the laminate, it would seem logical to begin each counting cycle at a point where each circuit begins. In some instances, many of the holes 40a, 40b and 40c, and the slots 42a and 42b, are located near or at the beginning of a twelve-inch circuit section in some codes. As the laminate 32 is moved adjacent to the camera 52, it may shift from side to side or become skewed. Under these conditions, it is sometimes difficult to initiate the counting cycle precisely at the origin of each twelve-inch circuit section which will ultimately form a flexible printed circuit. For example, if the trailing holes of one circuit section are very close to the termination of that section and the section is skewed adjacent to the camera 52, the trailing holes could be counted as leading holes in the next successive section. As a result, the system 46 would indicate a hole error in both sections. Thus, it would be desirable to start and complete the count cycle by scanning an area which did not contain any holes.

The counter reset circuit 72 provides facilities for selecting the starting point of a twelve-inch counting cycle by setting the start point a specified distance from one of the tool holes 40c or one of the X-slots 42a and in an area containing no holes. In this manner, each count cycle would begin with a first scan line at the same position on each circuit section and, if desired, the position could be other than the origin of the twelve-inch section which will form a printed circuit. Such a count cycle would extend a distance of twelve inches before reading a comparison of actual and preset counts and before beginning the next successive count cycle.

Initially, the repetitive pattern of each given circuit code to be manufactured is examined to determine whether there are any side-to-side clear areas which do not contain any holes, Typically, such areas may be located a distance from the actual origin of the circuit section and measurable by a specific number of tool holes 40c from the X-slot 42a. Or, each circuit section to be examined may contain a given number of tool holes 40c between such successive clear areas. This data is then compiled and made available to an operator as each code is to be manufactured. The data, as provided to an operator in preparation for the manufacture of a selected code, will instruct the operator to either base the count-cycle starting point on an "X SLOT" option or a "TOOL HOLE" option.

Referring to FIG. 10A, if the "X SLOT" option is selected, a manually operable, single-pole double-throw switch 246 is set to a "X SLOT" position which connects the switch to "+V." Then, in accordance with the data, the operator may be instructed to start the count cycle a given number of tool holes 40c after the X-slot 42a, whereby an adjustment is made to a BCD thumb wheel switch 248 to preset the number of tool holes to be counted.

If the operator is instructed to use the number of tool holes 40c within each circuit section to be examined to establish the starting point for each counting cycle, the switch 246 is set at "TOOL HOLE" position which connects the switch to "−V". The switch 248 is then set to the number of tool holes 40c in each circuit section.

Assume that a holeless clear area has been located and that it is repeated every twelve inches. Also assume that there are three tool holes 40c located between successive clear areas and that other holes 40a and 40b remain to be counted between the scan line of the third tool hole 40c and the next clear area.

Initially the "TOOL HOLE" option has been selected and, as noted before, there are three tool holes 40c within each of the successive circuit sections of repetitive patterns to be examined. The operator is instructed to position the switch 246 in the "TOOL HOLE" option and sets the BCD switch 248 at a count of three. Referring to FIG. 11, the underside of a section of the laminate 32 is illustrated and contains one tool hole 40c, one X-slot 42a and one hole 40a. The light source 48 is also illustrated with end portions of the light-emitting opening 94 extending from opposite sides of the laminate 32. As noted above, the laminate 32 may shift or skew whereby the edge of the laminate moves laterally relative to the opening 94 of the light source 48. Since each tool hole 40c and X-slot 42a is always a known distance from the adjacent edge of the laminate 32, it is important within the counter reset circuit 72 to know when the left edge, as viewed in FIG. 11, of the laminate appears during each scan cycle in order to establish a consistent point of reference between successive scans regardless of shifting or skewing of the laminate.

As shown on the "video" line of FIG. 11, the camera 52 is in a retrace mode before light is sensed at portion 94a of the opening 94. During the retrace mode, the video line is negative at location 250. When light is sensed at portion 94a, a positive pulse 252 is developed. When the left edge of the laminate 32 is scanned, the "video" line goes negative until too hole 40c is reached. At that time a positive pulse 254 is developed. Ultimately, pulse 256, representing the appearance of the X-slot 42a, and pulse 258, representing portion 94b of opening 94, are developed. Pulse 260 will not be developed during this scan cycle because it does not fall on any scan line coincident with any scan lines of the tool hole 40c and X-slot 42a. However, pulse 260 is illustrated in phantom to show that it will appear on a "video" line when the hole 40a is scanned during another cycle.

During the reset mode when the "video" line is negative at location 250, the camera 52 develops the retrace pulse 262. Referring to FIGS. 10A and 10B, the retrace pulse 262 is fed to the reset (R) input of a flip-flop 264, shift registers 266 and 268 and an AND gate 270. The retrace pulse 262 resets the flip-flop 264 and the shift registers 266 and 268. The shift registers 266 and 268, in combination with another shift register 272, form a count-pulse-producing shift register 274. When flip-flop 264 is reset, the "Q" output goes negative, as illustrated by negative pulse 276, during the leading positive transition of the retrace pulse 262. By application of the retrace pulse 262, the counter reset circuit 72 is prepared to receive incoming data for the ultimate resetting of the counter-comparator 70.

Figure 7:
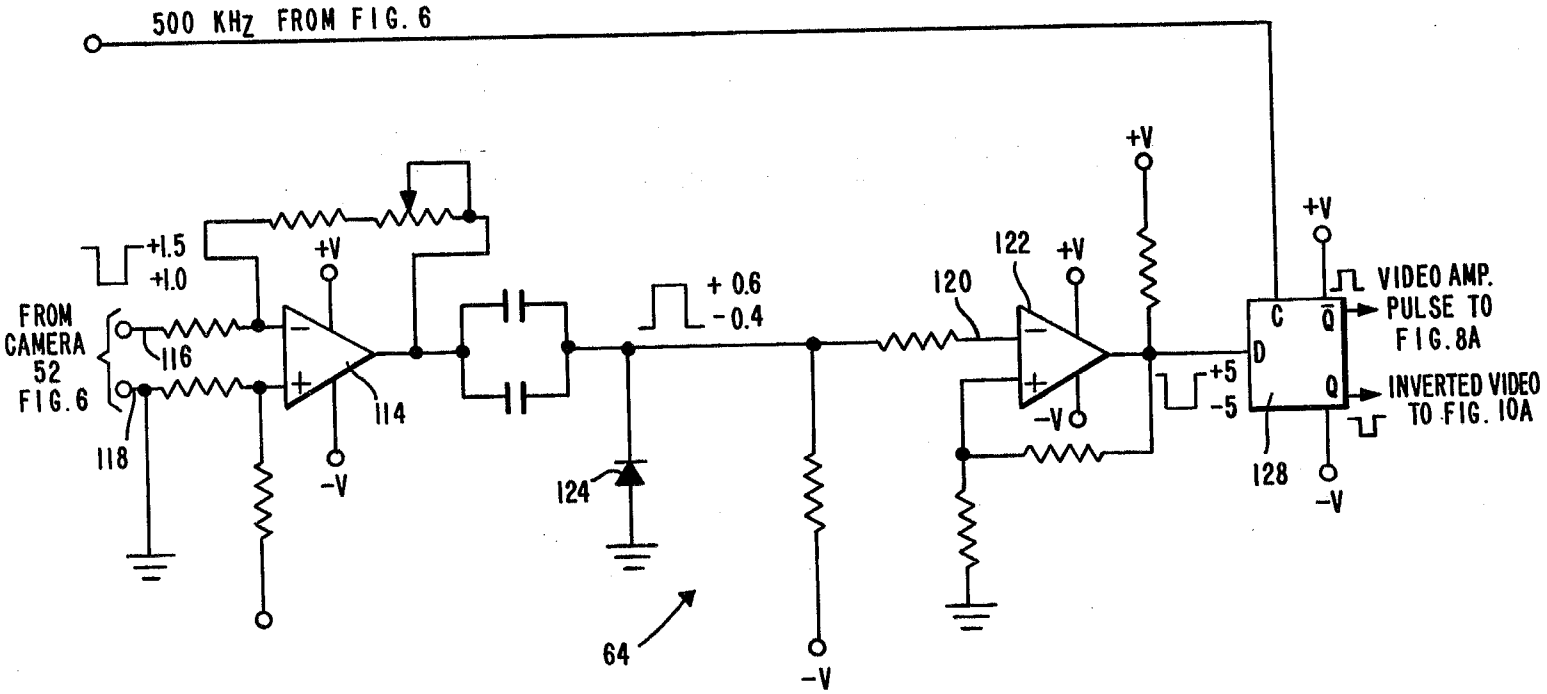
FIG. 7 is a schematic of a video amplifier which receives and amplifies all signals developed by the system in response to light sensed by the image sensor.

Thereafter, the inverted video pulse, which is an inverted version of the video pulse, is fed from the video amplifier 64 (FIG. 7) to the clock (C) input of flip-flop 264 which will set the flip-flop during the positive transition of the inverted video pulse. Referring to FIG. 11, it can be seen that the first positive transition of the inverted video pulse occurs when the trailing edge of pulse 252 occurs which is the result of the blocking of the light from the opening 94*a* by the edge of the laminate 32. Thus, the edge of the laminate 32 is thereby detected and can be used as a reference point for subsequent circuit operations during this scan cycle. Even though the laminate 32 may shift or skew during subsequent scan cycles, the operational cycle of the counter reset circuit 72 is started only when the edge of the laminate 32 is detected as represented by the positive-going, trailing transition of the inverted video pulse and the setting of the flip-flop 264. Thus, each scan cycle will have the same start-point reference, i.e., the edge of the laminate 32.

When flip-flop 264 is being set, the pulse 276 goes positive and is fed to the clock (C) input of a flip-flop 278. This results in the development of a positive pulse 280 (FIG. 11) which is fed to the data (D) input of the shift register 266. Pulse 280 is also fed to the reset (R) input of a counter 281 to reset the counter.

The 500 KHz clock signal is fed to each of the shift registers 266, 268 and 272 which provides the frequency for processing a pulse through the counting shift register 274. When the positive going pulse 280 is fed from flip-flop 278 to the shift register 266, the shift register begins to shift the pulse through the shift register 274. The initial or zero-count pulse of the shift register 266 is fed to the reset (R) input of flip-flop 278 to reset the flip-flop whereby pulse 280 is of short duration equal to the duration of one 500 KHz clock cycle.

Shift register 274 then processes the pulse therethrough at the 500 KHz frequency and provides several outputs at different count levels of nine, twenty-three, twenty-seven and thirty-one which are represented on the pulse line of shift register 274 as pulses 282–285, respectively.

Count-nine pulse 282 is fed from the shift register 274 to the set (S) input of a flip-flop 286 to set the flip-flop while twenty-seven-count pulse 284 is fed to the reset (R) input of the flip-flop to reset the flip-flop. This results in the development of a tool-hole-window pulse 288 (FIG. 11) appearing at the "Q" output of flip-flop 286 which is fed to the data (D) input of a normally set flip-flop 290. Flip-flop 290 requires simultaneous positive inputs to its data (D) and clock (C) inputs before the flip-flop is set. The tool-hole window represents the period of time during which the tool hole 40*c* should be present during the scan and is based on a time measurement extending between the nine and twenty-seven clock pulses of the shift register 274 as measured from the edge of the laminate 32.

Count-nine pulse is also fed to an AND gate 292 which also receives the video pulse developed in the counter reset circuit 72 by passing the inverted video pulse through an inverting buffer 294. This results in a positive pulse being fed to the reset (R) input of the normally set flip-flop 290 whereby the flip-flop is reset. When flip-flop 290 is reset, the "Q" output goes negative and the "$\overline{Q}$" output goes positive which is fed to one input of an AND gate 294. When the tool hole 40*c* is counted in the manner previously described, the count pulse is fed from the delay-and-compare circuit 66 (FIG. 8B) to the other input of AND gate 294 whereby a positive pulse is fed to the clock (C) input of flip-flop 290. Since both the data (D) and clock (C) inputs of flip-flop 290 are now positive, the flip-flop is returned to its normally set condition whereby the "Q" output goes positive. This results in the development of a tool-hole-found pulse 296 which represents that the tool hole 40*c* is coincident with and was located during the time of the tool-hole-window pulse 288 and is, therefore, the tool hole to be counted rather than another one of the many holes in the laminate 32.

The tool-hole-found pulse 296 is fed to a BCD counter 298 which further feeds a comparator 300. The preset tool-hole count of the BCD thumb-wheel switch 248 is also fed to the comparator 300 whereat the actual and preset counts are compared. The camera 52 continues to scan the moving laminate 32 and the system 46 counts the holes 40*a*, 40*b* and 40*c*, and the slots 42*a*, and 42*b*, as previously described. When the third tool hole 40*c* within the circuit section under examination is counted, the comparator 300 makes a favorable comparison between the actual and preset counts and feeds a positive output 302 (FIG. 11) to a NAND gate 304. When the switch 246 is placed in the "TOOL HOLE" option, (−V) is applied to an inverter 306 which provides a positive output. The positive output is fed to the other input of NAND gate 304 whereby the output of the NAND gate is negative. The negative output of NAND gate 304 is fed to a NOR gate 308 which feeds a positive input to the AND gate 270 which will be retained on the input of the AND gate until the counter 298 is reset.

Counter 281 is connected to receive and count incoming video pulses but will provide a positive output only when the first incoming video pulse of each scan cycle is counted. This output must be coincident with the retrace pulse and occur after the counting of the third tool hole 40*c* in order for an output to be developed on AND gate 270. Since counter 281 is reset during each scan cycle by pulse 280 (FIG. 11), which represents the edge of the laminate 32, the counter will count all video pulses occurring thereafter. As noted previously, there are additional holes 40*a* and 40*b* to be counted after the third tool hole 40*c* has been counted but before the clear area of no holes has been reached. Consequently, upon the occurrence of the video pulse of the first hole 40*a* or 40*b* on each scan line between the third tool hole 40*c* and the holeless clear area, a positive pulse appears at the output of the counter 281 and is fed to the AND gate 270. However, these video pulses of the first holes on each scan line do not occur simultaneously with the retrace pulse. Therefore, the output of AND gate 270 remains negative.

When the holeless clear area is first reached after the third tool hole 40*c* has been counted, the first time that light is sensed during the scan cycle is when the scan passes over the right edge of the laminate (FIG. 11) and senses the light emanating through portion 94*b* of the opening 94. This results in the development of video pulse 258 (FIG. 11) which is fed to the counter 281 to provide a positive count-one pulse 309 (FIG. 11) at the count-one output thereof. Pulse 309, as illustrated in FIG. 11, begins at the right side of the FIG. but continues on retrace at the left side until light is sensed again at portion 94*a* of the opening 94. Counter 281 then counts the second video pulse 252, which results from light emanating from portion 94*a* of opening 94, and the output moves to the count-two output of the counter which is not connected to any external circuit. Since no output pulse appears on the count-one output of counter 281, the pulse 309 terminates and the output goes negative as illustrated in FIG. 11. The negative output at the count-one output of counter 281 is then fed to AND gate 270 to inhibit the gate. When the left edge of the laminate 32 is sensed, as viewed in FIG. 11, pulse 280 is developed by flip-flop 278 and resets counter 281 to begin the next scan cycle.

During the period when pulse 309 is appearing at the count-one output of counter 281, the retrace pulse 262 (FIG. 11) will occur and all three inputs to AND gate 270 will be positive for the period of the retrace pulse whereby the output of the AND gate goes positive. The positive output of the AND gate 270 is fed to the set (S) input of a flip-flop 310 which sets the flip-flop.

When flip-flop 310 is set, the "$\overline{Q}$" output is fed to a counter 312. The 500 KHZ clock signal is fed to the clock (C) input of counter 312. When the "$\overline{Q}$" output of the set flip-flop 310 is fed to counter 312, the counter is enabled and begins to count at the 500 KHz frequency. As long as flip-flop 310 remains in the set state, counter 312 will continue to count. This is represented by an "enable" pulse 314 (FIG. 11). When count-one pulse occurs in counter 312, an output is fed through a dropping resistor 316 and an inverting buffer 318 to provide the "fault-detect reset" pulse 70*c* (FIG. 11) for resetting flip-flop 236 (FIG. 10B) in the counter-comparator circuit 70 as previously described.

When count-two pulse occurs in counter 312, a positive pulse is fed to one input of a NAND gate 320. The other input of NAND gate 320 is already positive by virtue of the positive output of NAND gate 306. The output of NAND gate 320 then goes negative and is fed to a NOR gate 322. The output of the NOR gate 322 goes positive and is fed to the reset (R) input of the BCD counter 298 to reset the counter. The output of the comparator 300 then goes negative and the outputs of NAND gates 270 and 302 and NOR gate 308 are reversed. Since flip-flop 310 has been set, it remains in this state and counter 312 thereby remains enabled to continue counting.

When count-three pulse of counter 312 occurs, an output is fed through a dropping resistor 324 and an inverting buffer 326 to provide the "read" pulse 70*a* (FIG. 11) which is fed to the counter-comparator circuit 70 (FIGS. 10A and 10B) as previously described.

When count-seven pulse of counter 312 occurs, an output is fed to an inverting buffer 328, a dropping resistor 330 and another inverting buffer 332 to provide the "counter reset" pulse 70*b* (FIG. 11) which is fed to the counter-comparator circuit 70 (FIGS. 10A and 10B) as previously described.

As previously described, the system 46 examines successive circuit sections of the laminate 32 to determine whether there are any holes missing in each section. If one or more holes are missing in any circuit section, the system 46 provides indication, by illuminating the red lamp 240 (FIG. 10B), that the circuit section has failed. If a selected number of successive circuit sections fail, it is imperative that the operator be made aware of these successive failures. Also, it is desirable to stop the punch press 44 at this time. In order to provide a warning to the operator, eight outputs of a counter 334 are connected to seven switches 334-1 through 334-7. The switches 334-1 through 334-7 are each connected to the base of a transistor 336 and the input of an inverter 338.

The number of successive circuit-section failures which will require operator attention and shutdown of the punch press 44 is selectable by closure of any one of the switches 334-1 through 334-7. For example, if the failure threshold is three successive circuit-section failures, switch 334-3 is closed while all other switches remain open.

It is noted that successive failures are indicative of continuing problems such as damaged, missing or worn punches and can not be tolerated. Therefore, the notification of such successive failures is imperative. Failures which are not successive up to the selected number and which occur infrequently can be tolerated. Thus, notification of such infrequent failures, other than the illuminating of red lamp 240, is not required.

A level-sensing circuit, designated generally by the numeral 340, includes a zener diode 342 and a transistor 344. When a circuit section contains all the required holes, ground is fed from the "$\overline{Q}$" output of flip-flop 236 in the counter-comparator circuit 70 (FIG. 10B) to the input of circuit 340 at zener diode 342. This provides a negative five volts (−V) across the zener diode 342 which is insufficient to break down the diode. Thus, the base of transistor 344 is at negative five volts (−V) and the transistor will not conduct. Since transistor 344 is not conducting, the reset (R) input of counter 334 is at a positive five volts (+V) which holds the counter in the reset mode.

When a defective circuit section is examined, a fault signal at positive five volts (+V) is fed from the "$\overline{Q}$" output of flip-flop 236 in the counter-comparator circuit 70 (FIG. 10B) and applied to the input of circuit 340 at the zener diode 342. Thus, ten volts is now applied across the diode 342 which causes the diode to break down and conduct. When this occurs, the base of transistor 344 is biased sufficiently to cause the transistor to conduct. This places a negative five volts (−V) at the reset (R) input of counter 334 to prevent the counter from going into the reset mode.

Regardless of the mode of the counter 334, when count-seven pulse occurs in counter 312, a positive pulse is fed to the input of an AND gate 346 with the other input thereof normally positive. The output of AND gate 346 goes positive and is fed to the clock (C) input of the counter 334 to register one count within the counter. If the circuit section which has just been examined contains all the required holes, counter 334 is in the reset mode as described before. Therefore, the input of the positive pulse at the clock (C) input of counter 334 has no effect on the counter.

If the circuit section has failed, the counter 334 is not in the reset mode and one count is registered in the counter when the positive pulse is fed from AND gate 346 to the counter. If the next circuit section contains the required number of holes, circuit 340 responds and facilitates the resetting of counter 334 whereby the registered one count is erased. However, if three successive circuit sections fail, four counts are registered in counter 334 whereby a positive pulse is fed through switch 334-3 to the base of transistor 336 whereby the transistor conducts. An alarm signal, which is a positive pulse at (+V) is then fed to the alarm circuit 74 (FIGS. 2 and 5). The positive pulse is also fed to the inverter 338 which feeds a negative pulse to the AND gate 346. This inhibits AND gate 346 and prevents subsequent positive pulses from being fed from the AND gate to the counter 334. Thus, the counter 334 is locked at the three count whereby the alarm signal continues to operate to insure that the operator is apprised of the three successive failures.

When count-eight pulse of counter 312 occurs, an output pulse 347 (FIG. 11) is fed to the reset (R) input of flip-flop 310 to reset the flip-flop which turns off the counter.

During the period when the positive output of gate 270 is fed to the flip-flop 310, it is also fed through an inverting buffer 348 to a timer 350 to start the timer. The output of the timer 350 is a positive pulse of extended pulse width when compared with the width of output pulses from counter 312 and determined by an RC network 351. The output of timer 350 is fed through a dropping resistor 352 and an inverting to buffer 354 to provide "blanking" pulse **70*d* (FIG. 11). "Blanking" pulse 70*d* is fed to the counter-comparator circuit 70 (FIGS. 10A and 10B) to momentarily turn off the digital-readout indicators 214—217** to provide indication that the system is representing a good count after each reset cycle.

When the "TOOL HOLE" option is selected in the manner described above, the counter reset circuit 72 responds to various input pulses at precise times during the examination of each circuit section and provides output pulses. These output pulses, which are developed at the conclusion of the examination of each circuit section, include the "fault-detect reset" pulse **70*c*, "blanking" pulse 70*d*, "read" pulse 70*a* and the "counter reset" pulse 70*b*. The circuit 72 also provides a single count pulse to counter 334** for each circuit section examined and an output alarm signal if a preset number of successive section failures has been reached.

Assume now that the operator has been instructed to select the "X SLOT" option and that the holeless clear area appears between the fourth and fifth tool hole **40*c* beyond the x-slot 42*a*. It is noted that the clear area may be some distance from the x-slot 42*a*** but the x-slot can be used as a point of reference on each circuit section to facilitate location of the clear area.

Referring to FIGS. 10A and 10B, the operator will place switch 246 in the "X-SLOT" position and set thumb-wheel switch 248 to a count of four. This places a positive five volts (+V) at the input of inverter 306. The output of inverter 306 goes negative and thereby inhibits NAND gates 302 and 320.

Flip-flops 264 and 268 and shift register 274 perform in the same manner as previously described in order to provide count-output pulses from the shift register. When count-twenty-three pulse 283 (FIG. 11) occurs, it is fed to the set (S) input of a flip-flop 360 to set the flip-flop. The "Q" output of flip-flop 360 goes positive which is fed to one input of an AND gate 362. When count-thirty-one pulse 285 (FIG. 11) occurs, flip-flop 360 is reset whereby the "Q" output goes negative and AND gate 362 is inhibited. During the period when flip-flop 360 is in the set mode, a positive pulse 364 (FIG. 11) appears at the "Q" output and represents an x-slot window during which the x-slot **42*a*** should occur.

The count-twenty-three pulse 283 is also fed to an AND gate 366. Video pulses appearing at the output of buffer 294 are also fed to AND gate 366. Since the x-slot-window pulse 364 (FIG. 11) was established to represent the time frame when an x-slot video pulse should occur, the output of AND gate 366 will go positive when pulse 364 and x-slot video pulse 256 occur simultaneously. Thus, positive output from AND gate 366 is fed to the set (S) input of a flip-flop 368 to set the flip-flop. At this time, the "Q" output of flip-flop 368 goes positive as illustrated by pulse 370 (FIG. 11) and represents that the x-slot **42*a* has been located. The positive "Q" output of flip-flop 368 is fed to an AND gate 372**.

When AND gate 366 goes positive, this output is also fed to an input of a NAND gate 374. The other input of NAND gate 374 is already positive through the "X SLOT" option of switch 246. When both inputs of NAND gate 374 are positive, the output goes negative which is fed to NOR gate 322. The output of NOR gate 322 then goes positive which is fed to the reset (R) input of BCD counter 298 to reset the counter to zero in preparation for counting four holes now that x-slot **42*a*** has been located.

When x-slot **42*a* is counted, a counter pulse is developed by the delay-and-compare circuit 66 (FIGS. 8A and 8B) and fed to the other input of AND gate 372 whereby both inputs are now positive and the output goes positive. The positive output of AND gate 372 is fed to AND gate 362 whereby both inputs are now positive and the output goes positive. The positive output of AND gate 362 is fed to the set (S) input of a flip-flop 376 which is thereby set. Even though the positive inputs to AND gates 362 and 372 may now be removed, flip-flop 376 remains in the set mode. When flip-flop 376 is in the set mode, the "Q" output is positive as illustrated by pulse 378 (FIG. 11). Pulse 378 represents that x-slot 42*a* has now been counted and the counting of the four succeeding tool holes 40*c*** can begin.

The positive "Q" output of flip-flop 376 is fed to one input of a NAND gate 380. The tool holes **40*c* eventually pass the camera 52 and are detected and counted. The counter reset circuit 72 processes the tool-hole pulses in the same manner as previously described whereby tool hole counts are fed to and stored in the BCD counter 298. When the actual tool-hole count in the counter 298 is equal to the count which is preset in the thumb-wheel switch 248, the output of comparator 300 goes positive and is fed to NAND gate 380. The output of NAND gate 380 goes negative and is fed to OR gate 308 which provides a positive output. The positive output is fed to one of the inputs to AND gate 270. This input to AND gate 270 will remain positive as long as the output of the comparator 300 and the "Q" of flip-flop 376** remain positive.

When the holeless clear area is reached, video pulse 258 (FIG. 11) occurs and is fed to counter 281 whereby pulse 309 (FIG. 11) appears at the count-one output of counter. When the next retrace pulse 262 (FIG. 11) occurs, all inputs of AND gate 270 are positive and the output goes positive. The positive output of AND gate 270 is fed to the set (S) input of flip-flop 310 to set the flip-flop. The positive output of AND gate 270 is also fed to the reset (R) input of flip-flop 376 to reset the flip-flop.

When the flip-flop 310 is set, counter 312 is enabled as previously described and proceeds through the counting cycle to provide the various output pulses to the counter-comparator circuit 70 (FIGS. 9A and 9B). A count pulse is also fed to counter 334 in the same manner previously described. Also, the timer 350 is started to provide the "blanking" pulse 70*d* (FIG. 11).

Thus, when the "X SLOT" option is selected, the counter reset circuit 72 operates in a manner similar to the operation during the "TOOL HOLE" option except that the point of starting the operation depends on the sensing and counting of the x-slot 42*a* before counting the tool holes 40*c*.

Alarm Circuit 74

When the preset number of successive circuit-section failures is reached, the counter 334 (FIG. 10B) provides a positive output through a selected one of the switches 334-1 through 334-8. Transistor 336 then conducts and the positive alarm signal is fed to the alarm circuit 74 (FIGS. 2 and 5).

Referring to FIG. 5, the positive alarm signal from the counter reset circuit 72 (FIG. 10B) is applied to a solid state relay 386 which, when operated, effectively connects together lines 388 and 390. This facilitates the application of 115 volts AC to a flasher 392 and a buzzer 394 as well as a lamp 396 connected across the buzzer. By operation of the flasher 392, the buzzer will provide an intermittent audible sound and the lamp 396 will operate intermittently. This combination will provide a visual and an audible alarm for the operator as indication of the preset number of successive circuit-section failures.

Operation of the solid state relay 386, also facilitates the application of 115 volts AC to the coil of a relay, designated generally by the numeral 398, to operate the relay. This results in the closure of contact 398-1 which locks the relay in the operated state. Also, contact 398-2, which is connected in the operating-power circuit (not shown) of the punch press 44 (FIG. 2), is opened. This shuts down the punch press 44 to stop the punching operation.

Since counter 334 (FIG. 10B) has reached the selected count, AND gate 346 has been inhibited by the negative output of NAND gate 338 as previously described. Therefore, the counter 334 is in the "count" or set mode at the preselected count and is held in this mode by the inhibiting of AND gate 346. When it is time to restart the punching operation and the hole counting process, counter 334 must be reset and operating power is to be applied to the punch press 44. This is accomplished by depressing manual switch 400 to facilitate the application of ground to the input of circuit 340 (FIG. 10B) whereby the circuit is biased to reset the counter. Operation of manual switch 400 also breaks the hold circuit for relay 398 and permits contact 398-2 to reclose whereby operating power can again be applied to the punch press 44.

The buffers 318, 326, 332 and 354 are the same type as buffer 110. The timer 350 is manufactured by Fairchild Semiconductor as their type uA556. The thumb wheel switch 248 is manufactured by Digitran Company as their model 311-1.

The following information identifies the remaining major components of the counter reset circuit and are all listed in the Data Book. The flip-flops 264, 278, 286, 290, 310, 360, 368 and 376 are identified as type MC14013. The shift registers 266 and 274 are identified as type MC14015. The shift register 272 is identified as type MC14006. The buffers 294, 328 and 348 are identified as type MC14049. AND gates 270, 292 and 366 are identified as type MC14073. AND gates 294, 346, 362 and 372 are identified as type MC14081. NAND gates 304, 320, 374 and 380 and inverters 306 and 338 are identified as type MC14011. NOR gates 308 and 322 are also identified as type MC14011 NAND gates but are connected in a negative-logic arrangement to function as NOR gates. Counters 281, 312 and 334 are identified as type MC14017 and counter 298 is identified as type MC14518. Comparator 300 is identified as type MC14585.

While the various components of the system 46 have been identified throughout the Detailed Description, such identification is by way of example and other compatible components may be used to replace those which have been identified without departing from the spirit and scope of the invention.

In summary, the system 46 scans the moving laminate 32 to count the number of holes 40*a*, 40*b* and 40*c*, and slots 42*a* and 42*b*, contained within each of many successive twelve-inch circuit sections in a length of 550 feet of the laminate. Due to the minuteness of some holes, the time for each scan cycle must be sufficiently fast to insure that such holes in the moving laminate 32 are scanned at least once. Consequently, the larger holes will be scanned many times whereby light is sensed for each hole during each of such scans and several light-sensed pulses are developed for the same hole. Therefore, the sensing of light can not be used as a hole-count indicator.

The system 46, within the delay-and-compare circuit 66, delays and, in effect, stores as digital memory each video pulse developed in response to the sensing of a given hole and compares the next video pulse from the given hole with the immediately preceding stored pulse. If a video pulse and a stored pulse are simultaneously present, no hole-count pulse is developed. When the hole has passed the camera 52, there is no video pulse for the next scan cycle following the given hole. When the immediately preceding stored pulse is compared with the time frame of the absent video pulse, this provides indication that the given hole has passed and a single hole-count pulse for the hole is developed.

Thus, where a plurality of successive holes occur along a single scan of the laminate 32, a train of successive video pulses will be developed. Each video pulse will appear in an associated one of successive time frames along the scan with each time frame representing the potential location of an associated one of the holes. The train of video pulses is delayed, and effectively stored as digital memory, for a period of one scan cycle. The train of stored pulses is compared with the corresponding successive time frames on the next succeeding scan of the laminate 32. In each instance where no video pulse occurs in any of the corresponding time frames during comparison with the corresponding stored pulse, a single count pulse is developed. In this manner, every hole appearing in the laminate 32 will be counted.

The hole-count pulses for each circuit section of the laminate 32 are compared with a preset count in the counter-comparator circuit 70 (FIGS. 9A and 9B). If the actual and preset counts compare favorably, visual indication is provided by green lamp 244 (FIG. 9B). If the actual and preset counts do not compare favorably, a visual indication is provided by red lamp 240 (FIG. 9B) which indicates that one circuit section of the laminate 32 had one or more holes missing. This indicates a hole-missing failure in one circuit section but does not indicate the number of missing holes. At the end of each counting cycle, indicators 214–217 (FIG. 9A) provide a readout of the actual number of holes counted during the counting cycle. If desired, visual comparison can be made with the preset count displayed on the BCD rotary switches 222–225.

Facilities are provided for presetting, within the system 46, the number of unacceptable successive circuit-section failures and, when such preset number is reached, for operating the buzzer 394.

The counter reset circuit 72 provides facilities for starting and completing each counting cycle in clear areas which do not contain holes to avoid counting errors which could occur in the event the laminate 32 shifts or skews as it passes the camera 52. This technique uses known information regarding the location of tool holes 40*c* and x-slots 42*a* in the laminate 32 and the number of tool holes within a given distance.

While the embodiment of the system 46 described herein is used to count holes and slots in the flexible laminate 32, it could be used to count holes in any substrate, flexible or rigid, in the same manner and is, therefore, not limited to use with flexible material. Also, the system 46 can detect the presence of an excessive number of holes when the hole count is compared with the preset count for each section. Indications of failure of the section are provided in the same manner as if the holes were missing.

Further, the principle of counting holes and detecting missing holes as used by the system 46 could be used to count and detect other properties. For example, if an article contained defects of a light-reflective property which is different from the light-reflective property of the remaining portion of the article, a light source could be directed onto the defect-containing surface of the article and the surface scanned by a light-sensing sensor in the manner described above with respect to the system 46. The response of the system 46 would be the same as described above. Thus, the only difference would be in the properties of the article being scanned.

What is claimed is:

1. A method of counting each of a plurality of light-emittable areas in a web, which comprises the steps of:
- directing light onto the plurality of light-emittable areas of the web so that each area emits light therefrom;
- passing successive scans of a light-sensing sensor over the light-emitting areas of the web with repetitive scan cycles;
- developing a pulse in response to the sensing of light from each light-emitting area during each scan, the developed pulse of each light-emitting area being located within a time frame on the scan, the time frame being representative of the potential location of the light-emitting area along the scan;
- storing each developed pulse for each light-emitting area sensed during the scan for a period equal to the time of a single scan cycle;
- comparing each stored pulse with the corresponding time frame of the next succeeding scan; and
- developing a single pulse for each light-emitting area in the web when no pulse is developed for the light-emitting area in the corresponding time frame of the next succeeding scan during the time when the stored pulse is being compared with the corresponding time frame.

2. A method of counting each of a plurality of holes in a web, which comprises the steps of:
- directing light through the plurality of holes from one side of the web;
- passing successive scans of a light-sensing sensor over the other side of the web with repetitive scan cycles;
- developing a pulse in response to the sensing of light through each hole during each scan, the developed pulse of each hole being located within a time frame on the scan, the time frame being representative of the potential location of the hole along the scan;
- storing each developed pulse for each hole sensed during the scan for a period equal to the time of a single scan cycle;
- comparing each stored pulse with the corresponding time frame of the next succeeding scan; and
- developing a single count pulse for each hole in the web when no pulse is developed for the hole in the corresponding time frame of the next succeeding scan during the time when the stored pulse is being compared with the corresponding time frame.

3. The method as set forth in claim 2 which further comprises the steps of:
- accumulating the total count of the count pulses developed in response to light-sensed holes; and
- comparing the accumulated total count with a predetermined count to ascertain whether the total number of holes in the web matches, or is a mismatch with, the predetermined count.

4. The method as set forth in claim 3 which further comprises the steps of:
- developing a pulse in response to a mismatch between the accumulated total count and predetermined count; and
- feeding the mismatch-developed pulse to an indicator to provide indication of the mismatch.

5. The method as set forth in claim 2 wherein the web is divided into a plurality of successive sections with each section containing a plurality of holes to be counted independently of the holes in the remaining sections, which further comprises the steps of:
- moving the web in a direction to move the successive sections thereof adjacent to the light and the light-sensing sensor;
- accumulating in a counter the total count of the count pulses developed in response to light-sensed holes in each successive section; and
- resetting the counter in response to, and immediately after, the completion of the counting of holes in each successive section in preparation for the counting of holes in the next successive section.

6. The method as set forth in claim 5 wherein each successive section contains a predetermined number of holes of the same size and shape which are clearly distinguishable from all other holes of the section and wherein spacing between successive sections does not contain any holes, which further comprises the steps of:
- counting the distinguishable holes in addition to all of the holes in the section;
- comparing the count of the distinguishable holes with the predetermined number of holes; and
- initiating the resetting step upon completion of the first scan after the count of the distinguishable holes equals the predetermined count and during which scan no holes are sensed.

7. The method as set forth in claim 5 which further comprises the steps of:

comparing the accumulated total count of each successive section with a predetermined count to ascertain whether the total number of holes in each successive section matches, or is a mismatch with, the predetermined count;

counting the number of successive sections in which the total number of holes in each section was a mismatch with the predetermined count; and stopping the movement of the web when the count of successive sections having hole-number mismatches has reached a predetermined number.

8. A method of counting each of a plurality of holes in a web, which comprises the steps of:

directing light through the plurality of holes from one side of the web;

passing successive scans of a light-sensing sensor over the other side of the web with repetitive scan cycles;

developing a train of pulses in response to the sensing of light through each of a plurality of holes during a single scan, each of the developed pulses being located within an associated one of successive time frames on the scan, each of the time frames being representative of the potential location of an associated one of the holes along the scan;

storing the train of developed pulses for a period equal to the time of a single scan cycle;

comparing the train of stored pulses with the corresponding successive time frames of the next succeeding scan; and developing a single count pulse for each hole in the web along the single scan when no pulse is developed in any of the corresponding time frames of the next succeeding scan during the time when the related one of the train of stored pulses is being compared with the corresponding time frame.

9. A system for counting each of a plurality of light-emittable areas in a web, which comprises:

means for directing light onto the plurality of light-emittable areas of the web so that each area emits light therefrom;

a light-sensing sensor;

means for passing successive scans of the light-sensing sensor over the light-emitting areas of the web with repetitive scan cycles;

means for developing a pulse in response to the sensing of light from each light-emitting area during each scan, the developed pulse of each light-emitting area being located within a time frame on the scan, the time frame being representative of the potential location of the light-emitting area along the scan;

means for storing each developed pulse for each light-emitting area sensed during the scan for a period equal to the time of a single scan cycle; and means for comparing each stored pulse with the corresponding time frame of the next succeeding scan and for developing a single pulse for each light-emitting area in the web when no pulse is developed for the light-emitting area in the corresponding time frame of the next succeeding scan during the time when the stored pulse is being compared with the corresponding time frame.

10. A system for counting each of a plurality of holes in a web, which comprises:

means for directing light through the plurality of holes from one side of the web;

a light-sensing sensor;

means for passing successive scans of the light-sensing sensor over the other side of the web with repetitive scan cycles;

means for developing a pulse in response to the sensing of light through each hole during each scan, the developed pulse of each hole being located within a time frame on the scan, the time frame being representative of the potential location of the hole along the scan;

means for storing each developed pulse for each hole sensed during the scan for a period equal to the time of a single scan cycle; and means for comparing each stored pulse with the corresponding time frame of the next succeeding scan and for developing a single count pulse for each hole in the web when no pulse is developed for the hole in the corresponding time frame of the next succeeding scan during the time when the stored pulse is being compared with the corresponding time frame.

11. The system as set forth in claim 10 which further comprises:

means for accumulating the total count of the count pulses developed in response to light-sensed holes; and means for comparing the accumulated total count with a predetermined count to ascertain whether the total number of holes in the web matches, or is a mismatch with, the predetermined count.

12. The system as set forth in claim 11 which further comprises the steps of:

means for developing a pulse in response to a mismatch between the accumulated total count and predetermined count; and means for feeding the mismatch-developed pulse to an indicator to provide indication of the mismatch.

13. The system as set forth in claim 10 wherein the web is divided into a plurality of successive sections with each section containing a plurality of holes to be counted independently of the holes in the remaining sections, which further comprises:

means for moving the web in a direction to move the successive sections thereof adjacent to the light and the light-sensing sensor;

a counter;

means for feeding into and accumulating in the counter the total count of the count pulse developed in response to light-sensed holes in each successive section; and means for resetting the counter in response to, and immediately after, the completion of the counting of holes in each successive section in preparation for the counting of the next successive section.

14. The system as set forth in claim 13 wherein each successive section contains a predetermined number of holes of the same size and shape which are clearly distinguishable from all other holes of the section and wherein spacing between successive sections does not contain any holes, which further comprises:

means for counting the distinguishable holes in addition to all of the holes in the section;

means for comparing the count of the distinguishable holes with the predetermined number of holes; and means for initiating the operation of the resetting means upon completion of the first scan after the count of the distinguishable holes equals the predetermined count and during which scan no holes are sensed.

15. The system as set forth in claim 13 which further comprises:

means for comparing the accumulated total count of each successive section with a predetermined count to ascertain whether the total number of holes in each successive section matches, or is a mismatch with, the predetermined count;

means for counting the number of successive sections in which the total number of holes in each section was a mismatch with the predetermined count; and means for stopping the movement of the web when the count of successive sections having hole-number mismatches has reached a predetermined number.

16. A system for counting each of a plurality of holes in a web, which comprises the steps of:

means for directing light through the plurality of holes from one side of the web;

a light-sensing sensor;

means for passing successive scans of the light-sensing sensor over the other side of the web with repetitive scan cycles;

means for developing a train of pulses in response to the sensing of light through each of a plurality of holes during a single scan, each of the developed pulses being located within an associated one of successive time frames on the scan, each of the time frames being representative of the potential location of an associated one of the holes along the scan;

means for storing the train of developed pulses for a period equal to the time of a single scan cycle;

means for comparing the train of stored pulses with the corresponding successive time frames of the next succeeding scan and for developing a single count pulse for each hole in the web along the single scan when no pulse is developed in any of the corresponding time frames of the next succeeding scan during the time when the related one of the train of stored pulses is being compared with the corresponding time frame.

17. The system as set forth in claim 10 wherein the storing means includes a shift register for shifting each developed pulse therethrough at a rate which effectively stores the developed pulse for a period equal to the time of a single scan cycle.

18. The system as set forth in claim 10 wherein the comparing and developing means includes:

means responsive to the presence of a developed pulse for generating a negative pulse at least during the time frame of the developed pulse to represent the developed pulse and for otherwise providing a positive output;

means responsive to the occurrence of the stored pulse during a period other than during the time frame and occurrence of the generated negative pulse for generating a stored negative pulse to represent the stored pulse;

means responsive to the generating of the stored negative pulse for developing short duration positive pulse representing the stored pulse and for delaying the short duration pulse for period sufficient to insure that the short duration pulse occurs during the time frame; and means responsive to the occurrence of the positive output of the negative-pulse generating means and the short-duration positive pulse for developing a pulse representative of a count of the hole.

19. A system for counting each of a plurality of holes in a web which comprises:

means for directing light through the plurality of holes from one side of the web;

a light sensing sensor;

means for passing successive scans of the light-sensing sensor over the other side of the web with repetitive scan cycles;

means for developing a pulse in response to the sensing of light through each hole during each scan, the developed pulse of each hole being located within a time frame on the scan, the time frame being representative of the potential location of the hole along the scan;

a shift register for shifting each developed pulse therethrough at a rate which effectively stores the developed pulse for a period equal to the time of a single scan cycle;

means responsive to the presence of a developed pulse for generating a negative pulse at least during the time frame of the developed pulse to represent the developed pulse and for otherwise providing a positive output;

means responsive to the occurrence of the stored pulse during a period other than during the time frame and occurrence of the generated negative pulse for generating a stored negative pulse to represent the stored pulse;

means responsive to the generating of the stored negative pulse for developing a short duration positive pulse representing the stored pulse and for delaying the short duration pulse for a period sufficient to insure that the short duration pulse occurs during the time frame; and means responsive to the occurrence of the positive output of the negative-pulse generating means and the short-duration positive pulse for developing a count pulse representative of a count of the hole.

* * * * *